US011315518B2

(12) United States Patent
Morein

(10) Patent No.: US 11,315,518 B2
(45) Date of Patent: Apr. 26, 2022

(54) DYNAMIC OVERDRIVE FOR LIQUID CRYSTAL DISPLAYS

(71) Applicant: Synaptics Incorporated, San Jose, CA (US)

(72) Inventor: Stephen L. Morein, San Jose, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/983,450

(22) Filed: Aug. 3, 2020

(65) Prior Publication Data

US 2020/0365109 A1 Nov. 19, 2020

Related U.S. Application Data

(63) Continuation of application No. 16/116,862, filed on Aug. 29, 2018, now Pat. No. 10,770,023.
(Continued)

(51) Int. Cl.
*G09G 3/36* (2006.01)
*G09G 3/34* (2006.01)

(52) U.S. Cl.
CPC ..... *G09G 3/3696* (2013.01); *G09G 3/3406* (2013.01); *G09G 3/3677* (2013.01);
(Continued)

(58) Field of Classification Search
CPC .. G09G 3/3696; G09G 3/3406; G09G 3/3677; G09G 3/3688; G09G 2310/08;
(Continued)

(56) References Cited

U.S. PATENT DOCUMENTS 7,898,519 B2 3/2011 Feng
8,259,139 B2 9/2012 Culbert et al.
(Continued)

FOREIGN PATENT DOCUMENTS

CN 105913825 A 8/2016
KR 10-2016-0034503 A 3/2016
KR 10-2018-0036429 A 4/2018

OTHER PUBLICATIONS

International Search Report and Written Opinion dated Aug. 2, 2019, issued in Intl. Appl. No. PCT/US2019/027561, 10 pages.
(Continued)

*Primary Examiner* — Bryan Earles
(74) *Attorney, Agent, or Firm* — Paradice & Li LLP

(57) ABSTRACT

A method and apparatus for overdriving pixel elements to a desired voltage. A display device comprises a pixel array and overdrive circuitry to determine a current pixel value for a first pixel element of the pixel array and a target pixel value for the first pixel element. The overdrive circuitry is further configured to determine a first voltage to be applied to the first pixel element to cause the first pixel element to transition from the current pixel value to the target pixel value by a first instance of time. The first voltage is determined based at least in part on a position of the first pixel element in the pixel array. The display device further comprises a data driver to apply the first voltage to the first pixel element before the first instance of time and a backlight to illuminate the pixel array at the first instance of time.

20 Claims, 11 Drawing Sheets

Related U.S. Application Data

(60) Provisional application No. 62/677,564, filed on May 29, 2018.

(52) U.S. Cl.
CPC ..... *G09G 3/3688* (2013.01); *G09G 2310/08* (2013.01); *G09G 2320/0252* (2013.01); *G09G 2320/0257* (2013.01); *G09G 2320/064* (2013.01); *G09G 2320/0666* (2013.01)

(58) Field of Classification Search
CPC ... G09G 2320/0252; G09G 2320/0257; G09G 2320/064; G09G 2320/0666; G09G 3/3648; G09G 2320/0285; G09G 2340/16
See application file for complete search history.

(56) References Cited

U.S. PATENT DOCUMENTS

| | | | | |
|---|---|---|---|---|
| 10,062,341 | B2 * | 8/2018 | He | G09G 3/3648 |
| 10,217,390 | B2 | 2/2019 | Gupta et al. | |
| 10,235,971 | B1 | 3/2019 | Chen et al. | |
| 10,395,583 | B1 * | 8/2019 | Dylewski | G09G 3/344 |
| 10,475,370 | B2 | 11/2019 | Spitzer et al. | |
| 2003/0006949 | A1 | 1/2003 | Sekiya et al. | |
| 2005/0146495 | A1 * | 7/2005 | MacKinnon | G09G 3/3611 345/98 |
| 2006/0238486 | A1 | 10/2006 | Hiraki | |
| 2008/0231624 | A1 | 9/2008 | Poon | |
| 2009/0046104 | A1 | 2/2009 | Boiko | |
| 2014/0184475 | A1 | 7/2014 | Tantos et al. | |
| 2015/0194119 | A1 | 7/2015 | Ahn et al. | |
| 2016/0232869 | A1 | 8/2016 | Ahn et al. | |
| 2016/0267715 | A1 | 9/2016 | Patel | |
| 2017/0018219 | A1 | 1/2017 | Wang et al. | |
| 2017/0236466 | A1 | 8/2017 | Spitzer et al. | |
| 2018/0095274 | A1 | 4/2018 | Lee et al. | |
| 2018/0136720 | A1 | 5/2018 | Spitzer et al. | |
| 2019/0035333 | A1 | 1/2019 | Chen et al. | |
| 2019/0035366 | A1 | 1/2019 | Li et al. | |
| 2019/0066608 | A1 | 2/2019 | Watanabe | |
| 2019/0156728 | A1 | 5/2019 | Yu et al. | |
| 2019/0189082 | A1 | 6/2019 | Shehata et al. | |

OTHER PUBLICATIONS

International Search Report and Written Opinion dated Nov. 20, 2019, issued in Intl. Appl. No. PCT/US2019/044931, 10 pages.

* cited by examiner

DYNAMIC OVERDRIVE FOR LIQUID CRYSTAL DISPLAYS

CROSS-REFERENCE TO RELATED APPLICATION

This application is a continuation of U.S. application Ser. No. 16/116,862, filed Aug. 29, 2018, entitled "DYNAMIC OVERDRIVE FOR LIQUID CRYSTAL DISPLAYS," which claims priority and benefit under 35 USC § 119(e) to U.S. Provisional Patent Application No. 62/677,564, filed on May 29, 2018, the entireties of which are incorporated by reference herein.

TECHNICAL FIELD

The present embodiments relate generally to liquid-crystal displays (LCDs), and specifically to dynamic overdrive techniques for LCD devices.

BACKGROUND OF RELATED ART

Head-mounted display (HMD) devices are configured to be worn on, or otherwise affixed to, a user's head. An HMD device may comprise one or more displays positioned in front of one, or both, of the user's eyes. The HMD may display images (e.g., still images, sequences of images, and/or videos) from an image source overlaid with information and/or images from the user's surrounding environment (e.g., as captured by a camera), for example, to immerse the user in a virtual world. HMD devices have applications in medical, military, gaming, aviation, engineering, and various other professional and/or entertainment industries.

HMD devices may use liquid-crystal display (LCD) technologies in their displays. An LCD display panel may be formed from an array of pixel elements (e.g., liquid crystal cells) arranged in rows and columns. Each row of pixel elements is coupled to a respective gate line, and each column of pixel elements is coupled to a respective data (or source) line. A pixel element may be accessed (e.g., updated with new pixel data) by driving a relatively high voltage on a gate line to "select" or activate a corresponding row of pixel elements, and driving another voltage on a corresponding data line to apply the update to the selected pixel element. The voltage level of the data line may depend on the desired color and/or intensity of the target pixel value. Thus, LCD display panels may be updated by successively "scanning" the rows of pixel elements (e.g., one row at a time), until each row of the pixel array has been updated.

The voltage applied on the data line changes the color and/or brightness of the pixel element by changing the physical state of (e.g., rotating) the particular pixel element. Thus, each pixel element may require time to settle into the new state or position. The settling time of a particular pixel element may depend on the degree of change in color and/or brightness. For example, transitioning from a maximum brightness setting (e.g., a "white" pixel) to a minimum brightness setting (e.g., a "black" pixel) may require greater settling time than transitioning from an intermediate brightness setting to another intermediate brightness setting (e.g., from one shade of "gray" to a different shade of "gray"). The delay in pixel transition may cause ghosting and/or other visual artifacts to appear on the display when the settling time of the pixel elements is slower than the time between successive frame updates.

LCD overdrive is a technique for accelerating pixel transitions when updating an LCD display. Specifically, a pixel element is driven to a higher voltage than the target voltage associated with the desired color and/or brightness level. The higher voltage causes the liquid crystal to rotate faster, and thus reach the target brightness in less time. On fixed LCD displays (e.g., televisions, monitors, mobile phones, etc.), an object is often illuminated by the same pixel elements for the duration of multiple frames. Thus, the amount of overdrive applied to the pixel elements of a fixed LCD display can be approximate since the user may be unable to detect errors in the corresponding pixel color and/or brightness when such errors last only a single frame. However, on HMD devices, and particularly in virtual reality (VR) applications, an object viewed on the display may be illuminated by different pixels as the user's head and/or eyes move. Therefore, the amount of overdrive applied to each pixel element of an HMD display should be much more precise to preserve the user's sense of immersion in the virtual environment.

SUMMARY

This Summary is provided to introduce in a simplified form a selection of concepts that are further described below in the Detailed Description. This Summary is not intended to identify key features or essential features of the claims subject matter, nor is it intended to limit the scope of the claimed subject matter.

A method and apparatus for overdriving pixel elements to a desired voltage. A display device a pixel array and overdrive circuitry to determine a current pixel value for a first pixel element of the pixel array and a target pixel value for the first pixel element. The overdrive circuitry is further configured to determine a first voltage to be applied to the first pixel element to cause the first pixel element to transition from the current pixel value to the target pixel value by a first instance of time. The first voltage is determined based at least in part on a position of the first pixel element in the pixel array. The display device further comprises a data driver to apply the first voltage to the first pixel element before the first instance of time and a backlight to illuminate the pixel array at the first instance of time.

The position of the first pixel element may correspond to a row position in the pixel array. In some embodiments, the first voltage may correspond to a target voltage when the row position is located below a threshold line number of the pixel array, wherein the target voltage causes the first pixel element to settle at the target pixel value. In some other embodiments, the first voltage may correspond to an overdrive voltage when the row position is located above the threshold line number of the pixel array, wherein the overdrive voltage is different than the target voltage.

In some embodiments, the overdrive circuitry may comprise a lookup table (LUT) repository configured to store a plurality of LUTs and an overdrive voltage generator to determine the first voltage based at least in part on the plurality of LUTs. In some aspects, each of the LUTs may indicate a plurality of overdrive voltages for pixel elements in a corresponding row of the pixel array.

In some embodiments, the overdrive voltage generator may select first and second LUTs of the plurality of LUTs based at least in part on the row position of the first pixel element. For example, the first LUT may be associated with a row of the pixel array below the row position of the first pixel element and the second LUT may be associated with a row of the pixel array above the row position of the first pixel element. The overdrive voltage generator may further determine the first voltage based at least in part on a linear interpolation of the first LUT and the second LUT. In some aspects, the overdrive voltage generator may select the first and second LUTs based at least in part on a temperature of the display.

In some embodiments, the overdrive voltage generator may comprise an LUT generator to generate an interpolated LUT based on the linear interpolation of the first and second LUTs. The overdrive voltage generator may further include an overdrive voltage interpolator configured to select at least two rows of the interpolated LUT based on the current pixel value and select at least two columns of the interpolated LUT based on the target pixel value. The overdrive voltage interpolator is further configured to determine the first voltage based on a bilinear interpolation of the selected rows and columns of the interpolated LUT.

In some embodiments, the overdrive circuitry may be further configured to determine a second voltage to be applied to a second pixel element of the pixel array to cause the second pixel element to transition from the current pixel value to the target pixel value by the first instance of time. More specifically, the second voltage may be different than the first voltage. In some aspects, the data driver may be further configured to apply the second voltage to the second pixel element before the first instance of time. In some aspects, the first pixel element may be located in a different row of the pixel array than the first pixel element.

BRIEF DESCRIPTION OF THE DRAWINGS

The present embodiments are illustrated by way of example and are not intended to be limited by the figures of the accompanying drawings.

DETAILED DESCRIPTION

Figure 1:
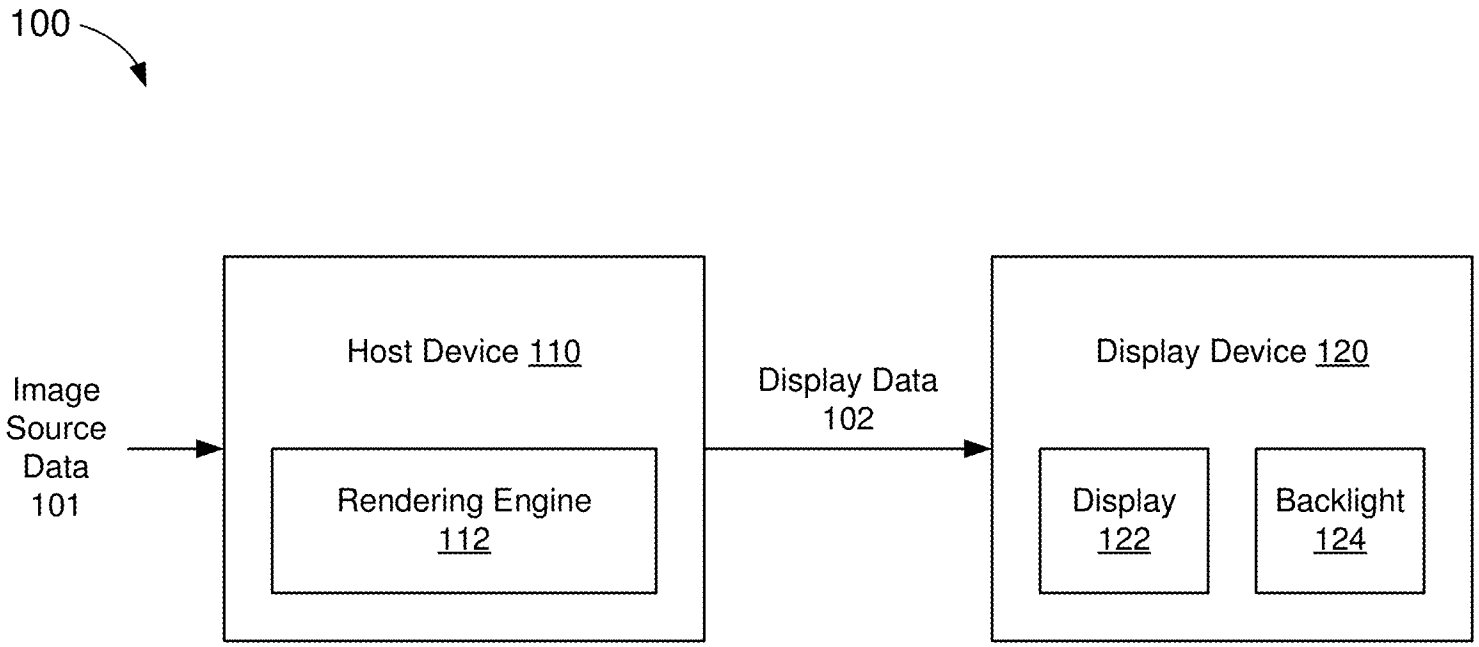
FIG. 1 shows an example display system within which the present embodiments may be implemented.

In the following description, numerous specific details are set forth such as examples of specific components, circuits, and processes to provide a thorough understanding of the present disclosure. The term "coupled" as used herein means connected directly to or connected through one or more intervening components or circuits. The terms "electronic system" and "electronic device" may be used interchangeably to refer to any system capable of electronically processing information. Also, in the following description and for purposes of explanation, specific nomenclature is set forth to provide a thorough understanding of the aspects of the disclosure. However, it will be apparent to one skilled in the art that these specific details may not be required to practice the example embodiments. In other instances, well-known circuits and devices are shown in block diagram form to avoid obscuring the present disclosure. Some portions of the detailed descriptions which follow are presented in terms of procedures, logic blocks, processing and other symbolic representations of operations on data bits within a computer memory.

These descriptions and representations are the means used by those skilled in the data processing arts to most effectively convey the substance of their work to others skilled in the art. In the present disclosure, a procedure, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system. It should be borne in mind, however, that all of these and similar terms are to be associated with the appropriate physical quantities and are merely convenient labels applied to these quantities.

Unless specifically stated otherwise as apparent from the following discussions, it is appreciated that throughout the present application, discussions utilizing the terms such as "accessing," "receiving," "sending," "using," "selecting," "determining," "normalizing," "multiplying," "averaging," "monitoring," "comparing," "applying," "updating," "measuring," "deriving" or the like, refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

In the figures, a single block may be described as performing a function or functions; however, in actual practice, the function or functions performed by that block may be performed in a single component or across multiple components, and/or may be performed using hardware, using software, or using a combination of hardware and software. To clearly illustrate this interchangeability of hardware and software, various illustrative components, blocks, modules, circuits, and steps have been described below generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. Also, the example input devices may include components other than those shown, including well-known components such as a processor, memory and the like.

The techniques described herein may be implemented in hardware, software, firmware, or any combination thereof, unless specifically described as being implemented in a specific manner. Any features described as modules or components may also be implemented together in an integrated logic device or separately as discrete but interoperable logic devices. If implemented in software, the techniques may be realized at least in part by a non-transitory processor-readable storage medium comprising instructions that, when executed, performs one or more of the methods described above. The non-transitory processor-readable data storage medium may form part of a computer program product, which may include packaging materials.

The non-transitory processor-readable storage medium may comprise random access memory (RAM) such as synchronous dynamic random access memory (SDRAM), read only memory (ROM), non-volatile random access memory (NVRAM), electrically erasable programmable read-only memory (EEPROM), FLASH memory, other known storage media, and the like. The techniques additionally, or alternatively, may be realized at least in part by a processor-readable communication medium that carries or communicates code in the form of instructions or data structures and that can be accessed, read, and/or executed by a computer or other processor.

The various illustrative logical blocks, modules, circuits and instructions described in connection with the embodiments disclosed herein may be executed by one or more processors. The term "processor," as used herein may refer to any general purpose processor, conventional processor, controller, microcontroller, and/or state machine capable of executing scripts or instructions of one or more software programs stored in memory. The term "voltage source," as used herein may refer to a direct-current (DC) voltage source, an alternating-current (AC) voltage source, or any other means of creating an electrical potential (such as ground).

FIG. 1 shows an example display system 100 within which the present embodiments may be implemented. The display system 100 includes a host device 110 and a display device 120. The display device 120 may be any device configured to display an image, or sequence of images (e.g., video), to a user. In some embodiments, the display device 120 may be a head-mounted display (HMD) device. In some aspects, the host device 110 may be implemented as a physical part of the display device 120. Alternatively, the host device 110 may be coupled to (and communicate with) components of the display device 120 using various wired and/or wireless interconnection and communication technologies, such as buses and networks. Example technologies may include Inter-Integrated Circuit ($1^2C$), Serial Peripheral Interface (SPI), PS/2, Universal Serial bus (USB), Bluetooth®, Infrared Data Association (IrDA), and various radio frequency (RF) communication protocols defined by the IEEE 802.11 standard.

The host device 110 receives image source data 101 from an image source (not shown for simplicity) and renders the image source data 101 for display (e.g., as display data 102) on the display device 120. In some embodiments, the host device 110 may include a rendering engine 112 configured to process the image source data 101 according to one or more capabilities of the display device 120. For example, in some aspects, the display device 120 may display a dynamically-updated image to a user based on the user's eye position. More specifically, the display device 120 may track the user's head and/or eye movements and may display a portion of the image coinciding with a fixation point of the user (e.g., foveal region) with higher resolution than other regions of the image (e.g., the full-frame image). Thus, in some embodiments, the rendering engine 112 may generate a high-resolution foveal image to be overlaid in the foveal region of the full-frame image. In some other embodiments, the rendering engine 112 may scale the full-frame image for display (e.g., at a lower-resolution than the foveal image) on the display device 120.

The display device 120 receives the display data 102 from the host device 110 and displays a corresponding image to the user based on the received display data 102. In some embodiments, the display device 120 may include a display 122 and a backlight 124. The display 122 may be a liquid-crystal display (LCD) panel formed from an array of pixel elements (e.g., liquid crystal cells) configured to allow varying amounts of light to pass from one surface of the display panel to another (e.g., depending on a voltage or electric field applied to each pixel element). For example, the display device 120 may apply an appropriate voltage to each of the pixel elements to render an image (which may include a foveal image overlaid upon a full-frame image) on the display 122. As described above, LCDs do not emit light and therefore rely on a separate light source to illuminate the pixel elements so that the image is viewable by the user.

The backlight 124 may be positioned adjacent the display 122 to illuminate the pixel elements from behind. The backlight 124 may comprise one or more light sources including, but not limited to, cold cathode fluorescent lamps (CCFLs), external electrode fluorescent lamps (EEFLs), hot-cathode fluorescent lamps (HCFLs), flat fluorescent lamps (FFLs), light-emitting diodes (LEDs), or any combination thereof. In some aspects, the backlight 124 may include an array of discrete light sources (such as LEDs) that can provide different levels of illumination to different regions of the display 122. In some embodiments, the display device 120 may include an inverter (not shown for simplicity) that can dynamically alter the intensity or brightness of the backlight 124, for example, to enhance image quality and/or conserve power.

As described above, the color and/or brightness of each pixel element may be adjusted by changing the voltage applied to that pixel element. However, the degree of change in color and/or brightness that can be achieved in a single frame transition or update may be limited by the settling time of the pixel element. For example, transitioning from a maximum brightness setting (e.g., a "white" pixel) to a minimum brightness setting (e.g., a "black" pixel) may require greater settling time than transitioning from an intermediate brightness setting to another intermediate brightness setting (e.g., from one shade of "gray" to a different shade of "gray"). If the pixel element is unable to achieve the desired color and/or brightness between successive frame updates, artifacts (such as ghosting) may appear in the displayed image.

LCD overdrive is a technique for increasing the speed of pixel transitions when updating an LCD display. Specifically, a pixel element is driven to a higher voltage than the target voltage associated with the desired color and/or brightness level. The higher voltage causes the liquid crystal in each pixel element to rotate faster, and thus reach the target brightness in less time. Thus, in some embodiments, the display system 100 may include overdrive circuitry (not shown for simplicity) that can dynamically adjust the amount of voltage to be applied to each pixel element in the display 122 to reduce the occurrence of artifacts and/or prevent them from interfering with the user's viewing experience.

Figure 2:
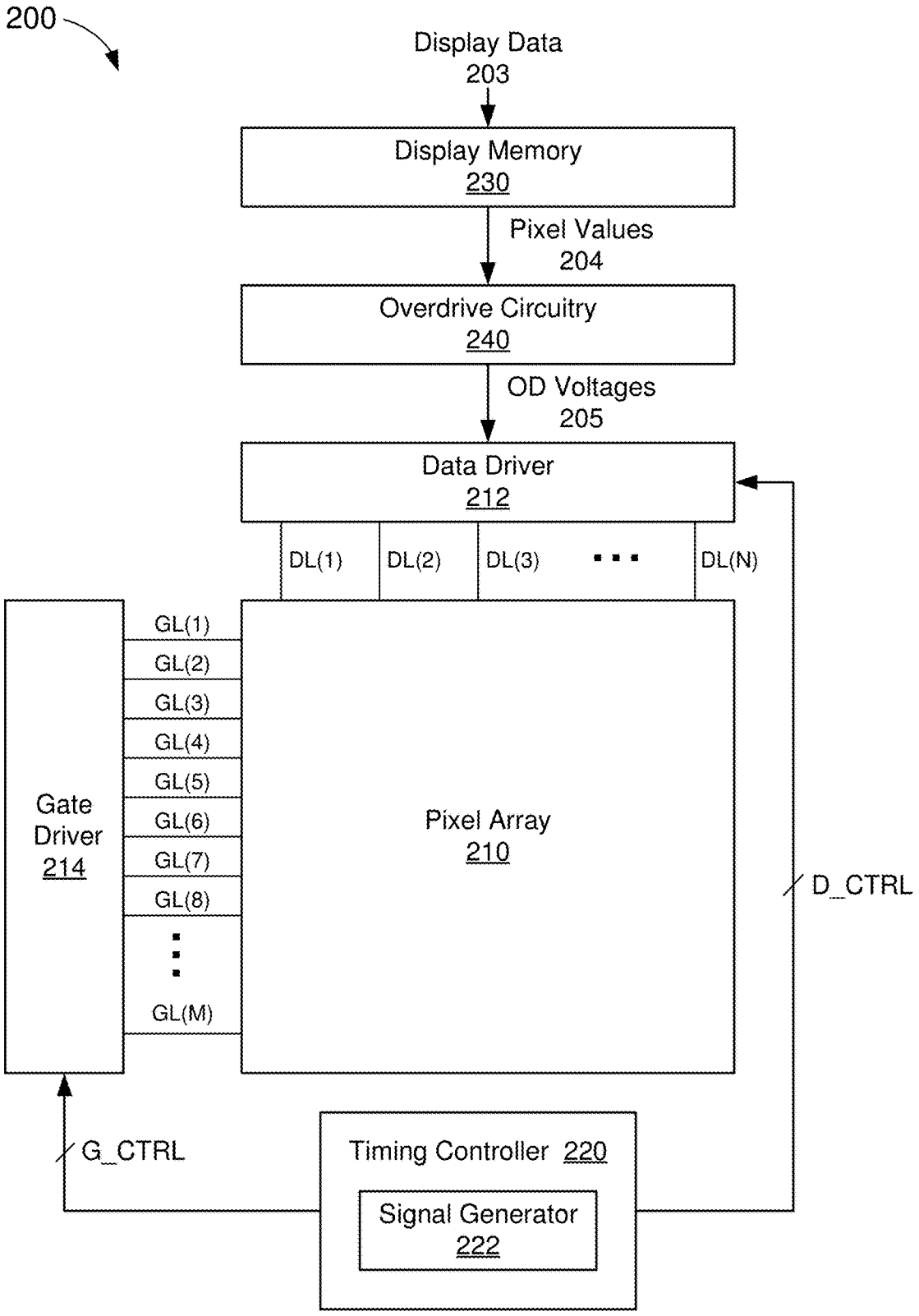
FIG. 2 shows a block diagram of a display device with overdrive circuitry, in accordance with some embodiments.

FIG. 2 shows a block diagram of a display device 200 with overdrive circuitry, in accordance with some embodiments. The display device 200 may be an example embodiment of the display 122 of the display device 120 of FIG. 1. More specifically, the display device 200 may include a pixel array 210, a timing controller 220, a display memory 230, and overdrive (OD) circuitry 240. In some embodiments, the display device 200 may correspond to an LCD display panel. Thus, the pixel array 210 may comprise a plurality of liquid crystal pixel elements (not shown for simplicity). Each row of pixel elements is coupled to a respective gate line (GL), and each column of pixel elements is coupled to a respective data line (DL). Accordingly, each pixel element in the array 210 is positioned at an intersection of a gate line and a source line.

A data driver 212 is coupled to the pixel array 210 via the data lines DL(1)-DL(N). In some aspects, the data driver 212 may be configured to drive pixel data (e.g., in the form of a corresponding voltage) to individual pixel elements, via the data lines DL(1)-DL(N), to update a frame or image displayed by the pixel array 210. For example, the voltage driven onto the data lines DL(1)-DL(N) may alter the physical state (e.g., rotation) of the pixel elements in the array 210 (e.g., where the pixel elements are liquid crystals). Thus, the voltage applied to each pixel element may directly affect the color and/or intensity of light emitted by that pixel element. It is noted that each row of pixel elements in the pixel array 210 is coupled to the same data lines DL(1)-DL(N). Thus, the display device 200 may update the pixel array 210 by successively scanning the rows of pixel elements.

A gate driver 214 is coupled to the pixel array 210 via the gate lines GL(1)-GL(M). In some aspects, the gate driver 214 may be configured to select which row of pixel elements is to receive the pixel data driven by the data driver 212 at any given time. For example, each pixel element in the array 210 may be coupled to one of the data lines DL(1)-DL(N) and one of the gate lines GL(1)-GL(M) via an access transistor (not shown for simplicity). The access transistor may be an NMOS (or PMOS) transistor having a gate terminal coupled to one of the gate lines GL(1)-GL(M), a drain (or source) terminal coupled to one of the source lines DL(1)-DL(N), and a source (or drain) terminal coupled to a corresponding pixel element in the array 210. When one of the gate lines GL(1)-GL(M) is driven with a sufficiently high voltage, the access transistors coupled to the selected gate line turn on and allow current to flow from the data lines DL(1)-DL(N) to the corresponding row of pixel elements. Accordingly, the gate driver 214 may be configured to select or activate each of the gate lines GL(1)-GL(M), in succession, until each row of the pixel array 210 has been updated.

The timing controller 220 is configured to control a timing of the data driver 212 and the gate driver 214. For example, the timing controller 220 may generate a first set of timing control signals (D_CTRL) to control activation of the data lines DL(1)-DL(N) by the data driver 212. The timing controller 220 may also generate a second set of timing control signals (G_CTRL) to control activation of the gate lines GL(1)-GL(M) by the gate driver 214. The timing controller 220 may generate the S_CTRL and G_CTRL signals based on a reference clock signal generated by a signal generator 222. For example, the signal generator 222 may be a crystal oscillator. The timing controller 220 may drive the D_CTRL and G_CTRL signals based by applying respective phase offsets to the reference clock signal. More specifically, the timing of the D_CTRL signals and G_CTRL signals may be synchronized such that the gate driver 214 activates the correct gate line (e.g., coupled to the row of pixel elements to be driven with pixel data) at the time the data driver 212 drives the data lines DL(1)-DL(N) with the pixel data intended for that row of pixel elements.

The display memory 230 may be configured to store or buffer display data 203 to be displayed on the pixel array 210. The display data 203 may include pixel values 204 (e.g., corresponding to a color and/or intensity) for each pixel element in the array 210. For example, each pixel element may comprise a plurality of subpixels including, but not limited to, red (R), green (G), and blue (B) subpixels. In some aspects, the display data 203 may indicate R, G, and B values for the subpixels of the image to be displayed. The R, G, and B values may affect the color and intensity (e.g., gray level) of each pixel element. For example, each pixel value 204 may be an 8-bit value representing one of 256 possible grayscale levels. As described above, each pixel value 204 may be associated with a target voltage level. In other words, when the target voltage is applied to a particular pixel element, the color and/or brightness of the pixel element will eventually settle to the desired pixel value. However, the settling time of the pixel element may depend on the degree of change in pixel value. Thus, if the change in pixel value exceeds a threshold amount, the target voltage may be insufficient to drive the pixel element to the desired pixel value within a given frame update period.

The overdrive circuitry 240 may determine an overdrive voltage 205 to be applied to one or more pixel elements in the array 210 based, at least in part, on the pixel values 204. More specifically, for each pixel element of the array 210, the overdrive circuitry 240 may compare the current pixel value (e.g., the pixel value from a previous frame update) to a target pixel value (e.g., the pixel value for the next frame update) to determine the amount of voltage to be applied to the pixel element to effect the change in pixel value within a frame update period. In some aspects, the overdrive circuitry 240 may compare the current pixel value and target pixel value to corresponding values in a lookup table (LUT) to determine the overdrive voltage 205 to be applied to the pixel element to effect the desired change in pixel value. In some instances, the overdrive voltage 205 may exceed (e.g., may be higher or lower than) the target voltage. However, the overdrive voltage 205 may be limited (e.g., capped) by the voltage range of the data driver 212. Thus, a pixel element may not exceed a threshold change in pixel value within any frame update period.

As described above, individual rows of the pixel array 210 may be successively updated (e.g., one row at a time). However, the image rendered on the pixel array 210 may not be viewable unless the pixel elements are illuminated by a light source (such as the backlight 124 of FIG. 1). In a fixed LCD display, the backlight may provide continuous illumination to the pixel array (e.g., the backlight is constantly on or at least pulse-width modulated to a desired brightness level). Thus, any changes in pixel values may be noticeable as soon as the updated voltages are applied to the pixel elements. However, in virtual reality (VR) applications, an object viewed on the display may be illuminated by different pixels as the user's head and/or eyes move. Rapid changes in pixel values may cause motion blur and/or other artifacts in the images rendered on the LCD display, which may impair the virtual reality experience. The display device may reduce or prevent motion blur by periodically (rather than continuously) updating the display. For example, the display device may flash the backlight at periodic intervals so that rapid changes in pixel values in between such intervals are suppressed (e.g., similar to the saccadic suppression phenomenon in human visual perception).

Figure 3:
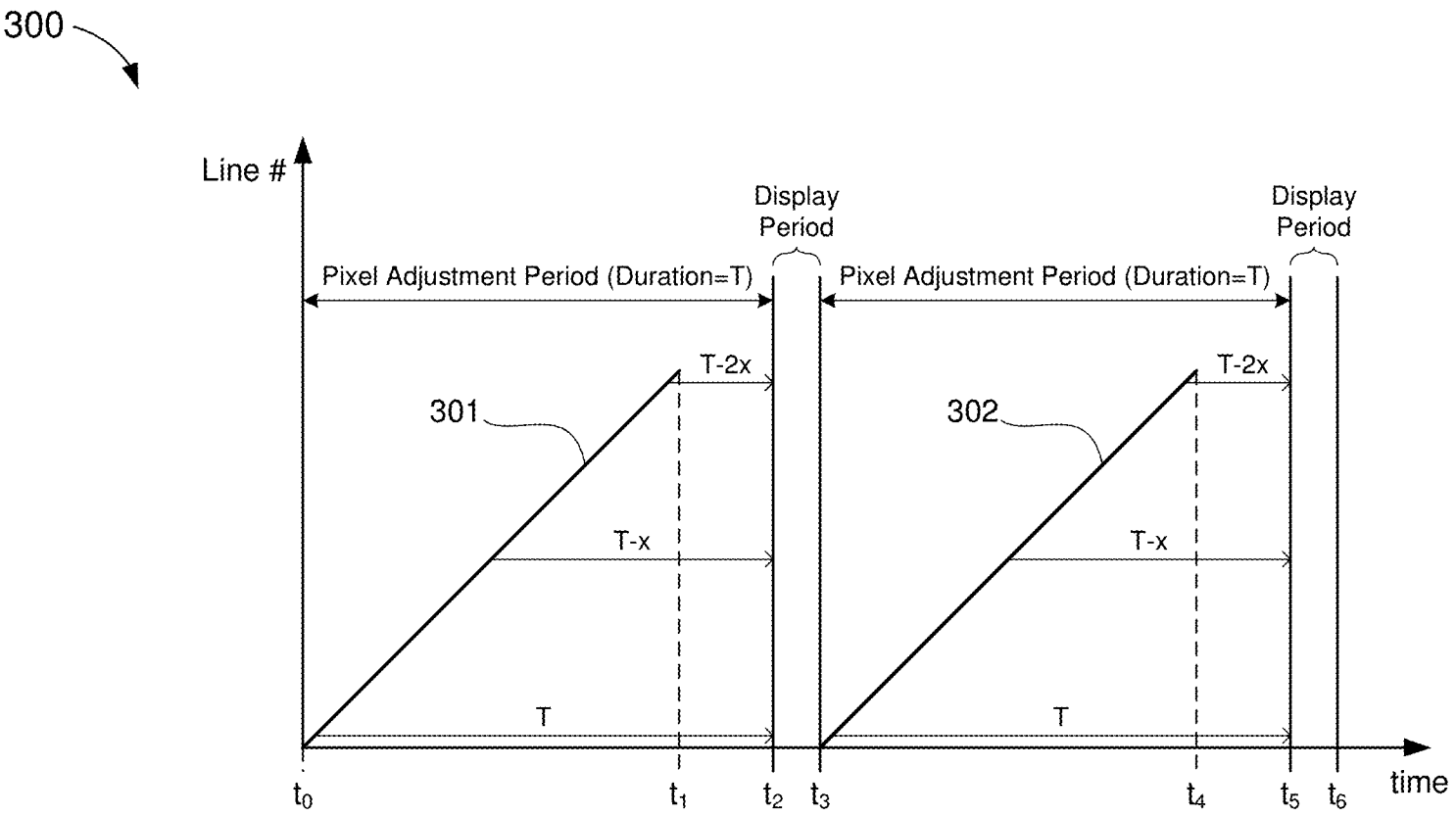
FIG. 3 shows a timing diagram depicting an example timing of pixel updates in a display device, in accordance with some embodiments.

With reference for example to the timing diagram 300 of FIG. 3, images may be periodically displayed by the pixel array 210 during successive frame update intervals. More specifically, each frame update interval (e.g. from times $t_0$-$t_3$ and $t_3$-$t_6$) may comprise a pixel adjustment period (e.g., from times $t_0$-$t_2$ and $t_3$-$t_5$) followed by a display period (e.g., from times $t_2$-$t_3$ and $t_5$-$t_6$). During each pixel adjustment period, the pixel array 210 may be driven with pixel updates (e.g., from times $t_0$-$t_1$ and $t_3$ to $t_4$). The updated pixel elements are then "displayed" (e.g. made viewable) to the user during the following display period. For example, the image on the pixel array 210 may be displayed to the user by activating a light source configured to illuminate the pixel array 210 (such as the backlight 124 of FIG. 1).

During each pixel adjustment period, individual rows of the pixel array 210 may be successively updated (e.g., in a cascaded fashion). The curves 301 and 302 show example pixel update times for each row of the pixel array 210 based on the line number associated with that row. Thus, as shown in FIG. 3, rows associated with higher line numbers (e.g., further down the cascade) are updated later than rows associated with lower line numbers (e.g., towards the start of the cascade). However, because the pixel elements are illuminated only during the display periods, any changes in pixel value exhibited before or after the display period will not be seen by the user. As a result, pixel elements associated with higher line numbers (e.g., pixel elements that are updated later) have less time to transition to their desired pixel values than pixel elements associated with lower line numbers (e.g., pixel elements that are updated earlier). For example, pixel elements at the top of the array 210 may have the duration (T) of the pixel adjustment period to reach their target pixel values. In contrast, pixel elements in the middle of the array 210 may have a significantly shorter duration (T−x) to reach their target pixel values, and pixel elements at the bottom of the array 210 may have an even shorter duration (T−2x) to reach their target pixel values.

Aspects of the present disclosure recognize that, due to the differences in transition times for the various rows of the pixel array 210, different amounts of overdrive may be applied to different rows of pixel elements. For example, pixel elements associated with relatively low line numbers may require less overdrive voltage (if any) to reach their target pixel values before the next display period. However, pixel elements associated with higher line numbers may require progressively more overdrive voltage to reach their target pixel values before the next display period. Thus, in some embodiments, the overdrive circuitry 240 may progressively increase the amount of overdrive applied to the rows of pixel elements based, at least in part, on their position (e.g., line number) in the array 210. More specifically, pixel elements that are associated with higher line numbers (e.g. updated later during the display update interval) are generally provided with greater amounts of overdrive voltage than pixel elements that are associated with lower line numbers (e.g., updated earlier during the display update interval).

Figure 4B:
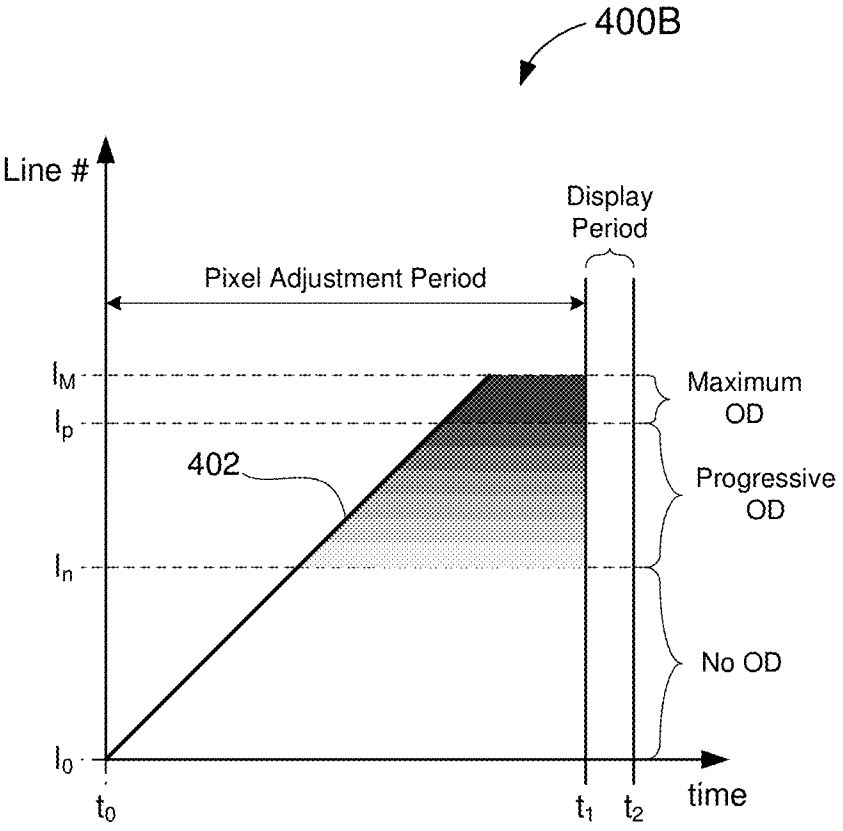
FIGS. 4A and 4B show timing diagrams depicting example implementations of progressive overdrive, in accordance with some embodiments.
Figure 4A:
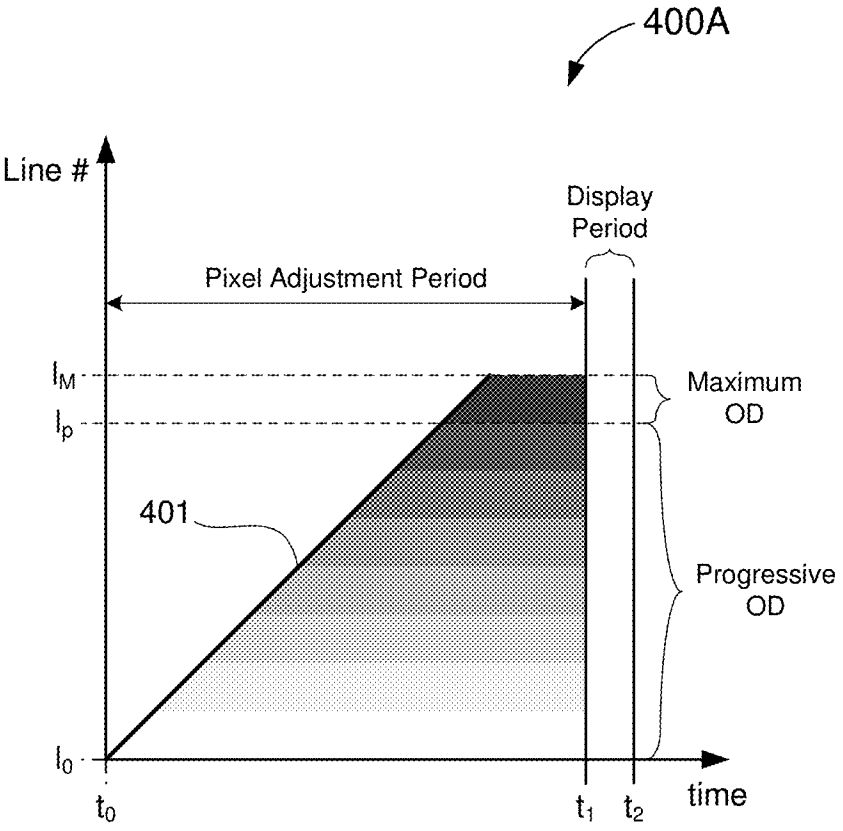

FIG. 4A shows a timing diagram 400A depicting an example implementation of progressive overdrive, in accordance with some embodiments. In some embodiments, the method of progressive overdrive illustrated in FIG. 4A may be implemented by the overdrive circuitry 240 of FIG. 2. The timing diagram 400A shows an example frame update interval (e.g. from times $t_0$-$t_2$) which may comprise a pixel adjustment period (e.g., from times $t_0$-$t_1$) followed by a display period (e.g., from times $t_1$-$t_2$). The curve 401 depicts example pixel update times for each row of the pixel array 210 based on the line number associated with that row.

In the example of FIG. 4A, the overdrive circuitry 240 may generate progressive overdrive voltages for successive rows of pixel elements between lines $l_0$ to $l_p$ of the pixel array 210. More specifically, the amount of overdrive voltage may be progressively increased for each successive row of pixel elements from lines $l_0$ to $l_p$. For example, a pixel element coupled to line $l_p$ may be driven to a higher voltage than a pixel element coupled to line $l_0$ to effect the same change in pixel value (e.g., same change in grayscale level) before the start of the display period. As described above, the amount of overdrive that can be applied to the pixel elements may be limited by the voltage range of the data driver 212. In the example of FIG. 4A, the overdrive voltage may become saturated by the time the pixel elements coupled to line $l_p$ are updated. Thus, the overdrive circuitry 240 may apply maximum overdrive to the rows of pixel elements between lines $l_p$ and $l_M$ of the pixel array 210. In other words, if any of the pixel elements between lines $l_p$ and $l_M$ are to be updated during the pixel adjustment period, the overdrive circuitry 240 may apply the maximum overdrive voltage to change the pixel values of such pixel elements.

Aspects of the present disclosure recognize that the need for progressive overdrive may vary depending on the characteristics of the LCD display (e.g., number of pixels, temperature, response time, etc.). For example, an LCD display with fewer pixel elements (or at least fewer lines of pixels) may require less time to update the entire pixel array. Thus, the change in overdrive from one row of pixel elements to another may be more gradual in a smaller pixel array. Aspects of the present disclosure further recognize that, in some embodiments, one or more rows of pixel elements may settle to their target pixel values, before the next display period, without the use of overdrive (e.g., by driving the pixel elements only up to the target voltage).

FIG. 4B shows a timing diagram 400B depicting another example implementation of progressive overdrive, in accordance with some embodiments. In some embodiments, the method of progressive overdrive illustrated in FIG. 4B may also be implemented by the overdrive circuitry 240 of FIG. 2. The timing diagram 400B shows an example frame update interval (e.g. from times $t_0$-$t_2$) which may comprise a pixel adjustment period (e.g., from times $t_0$-$t_1$) followed by a display period (e.g., from times $t_1$-$t_2$). The curve 402 depicts example pixel update times for each row of the pixel array 210 based on the line number (e.g., gate line) associated with that row.

In the example of FIG. 4B, the overdrive circuitry 240 may not apply any overdrive to the rows of pixel elements between lines $l_0$ and $l_n$ of the pixel array 210. Rather, each pixel element between lines $l_0$ and $l_n$ may be driven to its target voltage during the pixel adjustment period. The overdrive circuitry 240 may generate progressive overdrive voltages for successive rows of pixel elements between lines $l_n$ to $l_p$ of the pixel array 210. As described above, the amount of overdrive voltage may be progressively increased for each successive row of pixel elements from lines $l_n$ to $l_p$. In the example of FIG. 4B, the overdrive voltage may become saturated by the time the pixel elements coupled to line $l_p$ are updated. Thus, the overdrive circuitry 240 may apply maximum overdrive to the rows of pixel elements between lines $l_p$ and $l_M$ of the pixel array 210. In other words, if any of the pixel elements between lines $l_p$ and $l_M$ are to be updated during the pixel adjustment period, the overdrive circuitry 240 may apply the maximum overdrive voltage to change the pixel values of such pixel elements.

By applying overdrive in a progressive manner (e.g., as shown in FIGS. 4A and 4B), the overdrive circuitry 240 may ensure that each of the pixel elements in the array 210 is updated to its target pixel value (or at least a pixel value that is substantially close to the target pixel value) before the next display period. Furthermore, by selectively applying overdrive to only a portion of the pixel array (e.g., as shown in FIG. 4B), the embodiments herein may reduce the amount of resources (e.g., memory, time, power, and other processing resources) needed to generate the overdrive voltages for the pixel array 210.

Figure 5A:
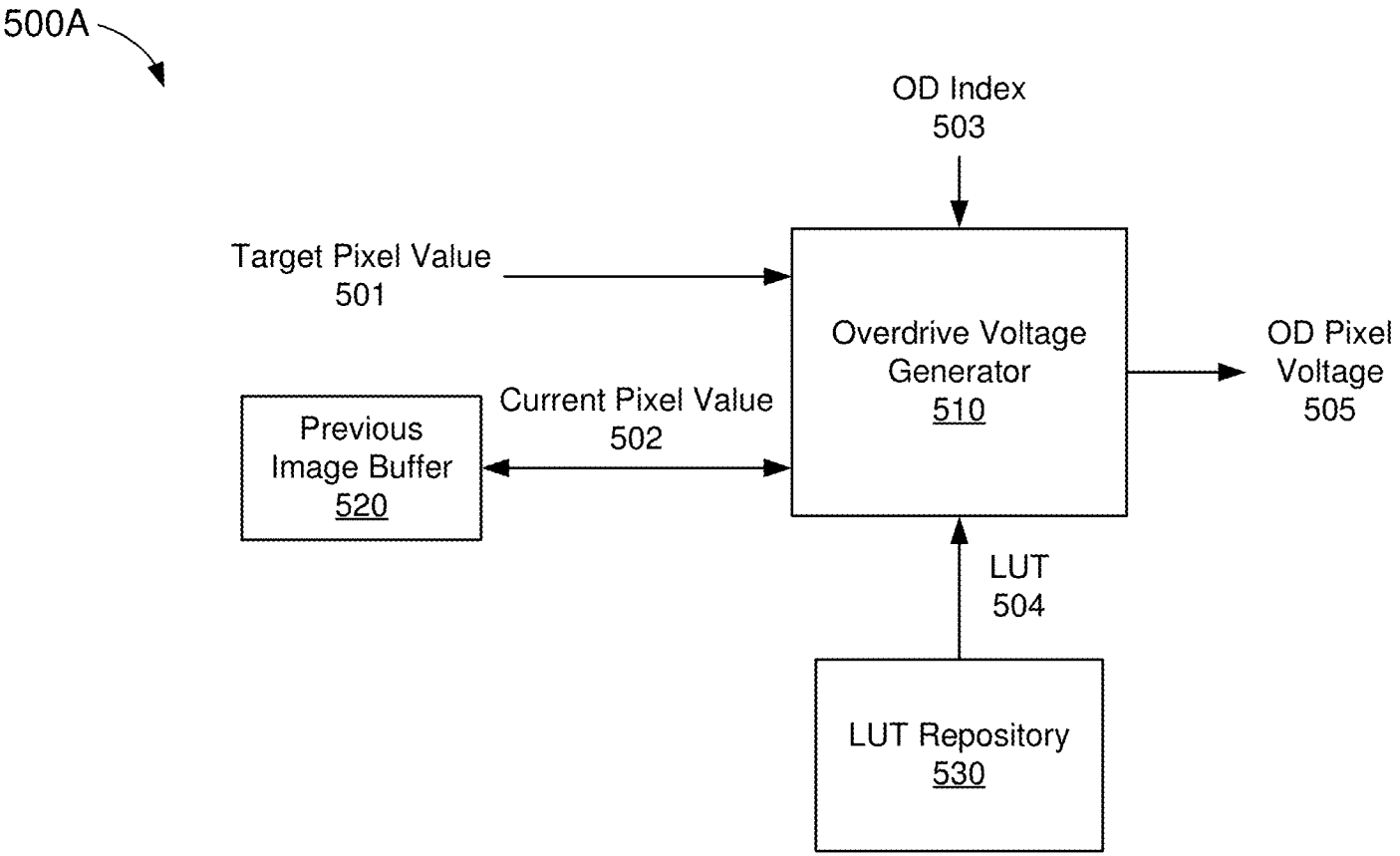
FIGS. 5A and 5B show block diagrams of a progressive overdrive controller, in accordance with some embodiments.

FIG. 5A shows a block diagram of a progressive overdrive controller 500A, in accordance with some embodiments. The progressive overdrive controller 500A may be an example embodiment of the overdrive circuitry 240 of FIG. 2. Thus, the progressive overdrive controller 500A may be configured to progressively increase the amount of overdrive applied to one or more rows of pixel elements of a pixel array (such as the pixel array 210 of FIG. 2) based, at least in part, on the row position in the array 210.

The progressive overdrive controller 500A includes an overdrive voltage generator 510, a previous image buffer 520, and a lookup table (LUT) repository 530. The overdrive voltage generator 510 may determine an overdrive pixel voltage 505 to be applied to each pixel element of the associated pixel array. More specifically, the overdrive voltage generator 510 may generate the overdrive pixel voltage 505 based, at least in part, on a target pixel value 501, a current pixel value 502, and an overdrive (OD) index 503. The target pixel value 501 may correspond to the pixel value that a particular pixel element is to be driven by the next display period. For example, the target pixel value 501 may be provided by an input image buffer (such as the display memory 230 of FIG. 2). The current pixel value 502 may correspond to the pixel value, for the particular pixel element, that was displayed during the previous display period. For example, the current pixel value 502 may be stored in, and retrieved from, the previous image buffer 520. In some aspects, after each frame update, the overdrive voltage generator 510 may store the target pixel value 501 of the current frame in the previous image buffer 520 (e.g., to be used as the current pixel value 502 for the next frame update).

In some embodiments, the overdrive voltage generator 510 may determine the overdrive pixel voltage 505 by comparing the target pixel value 501 with the current pixel value 502. More specifically, the progressive overdrive controller 510 may determine an amount of voltage to be applied to a corresponding pixel element to change the pixel value from the current pixel value 502 to the target pixel value 501. In some aspects, the overdrive voltage generator 510 may compare the target pixel value 501 and the current pixel value 502 to corresponding values in a lookup table (LUT) to determine the overdrive pixel voltage 505. For example, the rows of the LUT may correspond with a plurality of current pixel values and the columns of the LUT may correspond with a plurality of target pixel values. The intersection of a particular row and a particular column may indicate the overdrive voltage needed to change the pixel value from the current pixel value (of the corresponding row) to the target pixel value (of the corresponding column).

Conventional LCD displays use a single lookup table to determine the overdrive voltage to be applied to any pixel element in the pixel array. However, in HMD devices (and particularly for VR applications), different pixel elements may have different timing constraints (e.g., to reach a target brightness or pixel value) based on their position in the array (e.g., as described with respect to FIG. 3). For example, pixel elements in the first row of the array may have significantly more time to reach their target pixel values than pixel elements in the last row of the array. Thus, the progressive overdrive controller 500A may progressively increase (or decrease) the amount of overdrive voltage, to effect a given change in pixel value, for a plurality of successive rows of pixel elements in the pixel array (e.g., as described with respect to FIGS. 4A and 4B).

In some embodiments, the overdrive voltage generator 510 may use a plurality of LUTs to determine the overdrive pixel voltage 505. For example, the LUT repository 530 may store a plurality of LUTs that may be retrieved by the overdrive voltage generator 510. Each of the plurality of LUTs may be associated with a different row of pixel elements in the corresponding pixel array. For example, the LUT repository 530 may store a first LUT associated with the first row of the pixel array and a second LUT associated with the last row of the pixel array. The first LUT may indicate a plurality of overdrive voltages to be used to implement various changes in pixel values for any pixel element in the first row of the array, whereas the second LUT may indicate a plurality of overdrive voltages to be used to implement various changes in pixel values for any pixel element in the last row of the array. Since pixel elements in the last row of the array may have less time to reach their target pixel values than pixel elements in the first row of the array, the overdrive voltages in the second LUT may be greater than corresponding overdrive voltages in the first LUT.

In some embodiments, the overdrive voltage generator 510 may use the overdrive index 503 to determine the overdrive voltages for a particular row of pixel elements. More specifically, the overdrive index 503 may be used to select one or more LUTs from the LUT repository 530. For example, in some aspects, the overdrive index 503 may be based, at least in part, on the line or row number associated with the pixel elements to be driven. However, other factors may also affect the amount of overdrive voltage needed to achieve a desired change in pixel value within a frame update period. For example, the responsiveness of the liquid crystals may vary with respect to the temperature of the display. Warmer pixel elements tend to exhibit faster response times, and thus require less overdrive voltage to achieve the same change in pixel value, than colder pixel elements. Thus, for any given row of pixel elements, the overdrive voltage generator 510 may use a different LUT to determine the overdrive voltages under warmer temperature conditions than under colder temperature conditions. In some embodiments, the overdrive index 503 may be based on a combination of factors including, but not limited to, the line or row number associated with the pixel elements to be driven and the temperature of the display.

Figure 5B:
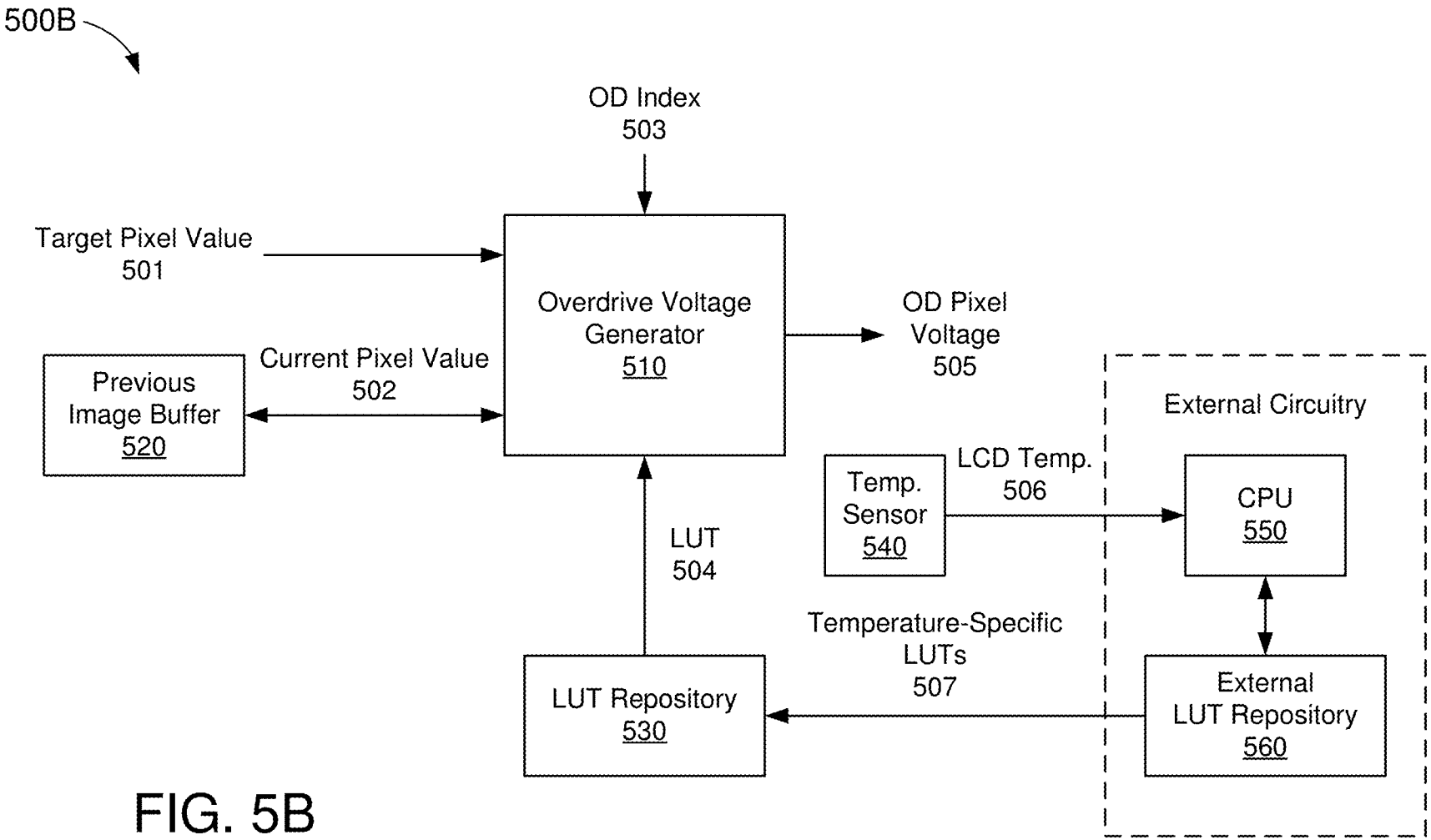

For example, FIG. 5B shows a progressive overdrive controller 500B that may dynamically adjust the overdrive pixel voltages 505 based on the temperature of the LCD display. In addition to the overdrive voltage generator 510, the previous image buffer 520, and the LUT repository 530 (described above with respect to FIG. 5A), the progressive overdrive controller 500B also includes a temperature sensor 540 that may provide temperature readings 506 to a processor (e.g., CPU) 550 external to the progressive overdrive controller 500B and/or the display driver. For example, the CPU 550 may reside on a host device (or elsewhere on the display device) that has greater memory and processing resources than the display driver. Because the temperature sensor 540 resides on the display device (e.g., proximate to the LCD display), the temperature readings 506 may provide a relatively accurate indication of the temperature of the LCD display.

In some embodiments, the CPU 550 may use the temperature readings 506 to select a set of temperature-specific LUTs 507 from an external LUT repository 560. As described above, the responsiveness of the liquid crystals in an LCD display may vary with respect to the temperature of the LCD display. Thus, for any given row of pixel elements, it may be desirable to use a different LUT to determine the overdrive voltages under warmer temperature conditions than under colder temperature conditions. However, aspects of the present disclosure recognize that the memory resources of the display driver may be very scarce. As a result, the LUT repository 530 may be able to store only a limited number of LUTs at any given time. Thus, in some embodiments, the CPU 550 may dynamically update and/or populate the LUT repository 530 with temperature-specific LUTs 507 retrieved from the external LUT repository 560 based on the current temperature of the LCD display (e.g., as indicated by the temperature readings 506).

In some embodiments, the LUT repository 530 may store a different LUT for each row of the pixel array. For example, the overdrive index 503 may specify the precise LUT 504 to be retrieved by the overdrive voltage generator 510 for a particular row of pixel elements. However, aspects of the present disclosure recognize that it may not be practical, or even feasible, to store that many LUTs (e.g., since an LCD display may contain hundreds, if not thousands, of rows of pixel elements). Thus, in other embodiments, the LUT repository 530 may store LUTs for only a subset of rows of the pixel array. Accordingly, the overdrive voltage generator 510 may determine the overdrive pixel voltage 505 for a particular pixel element based on a bilinear interpolation of multiple LUTs. For example, the overdrive voltage generator 510 may retrieve the two LUTs 504, from the LUT repository, that are closest to the overdrive index 503. The overdrive voltage generator 510 may then perform bilinear interpolation on the two LUTs 504 to determine the overdrive pixel voltage 505 to be applied to each pixel element in the selected row in order to change the corresponding pixel value from the current pixel value 502 to the target pixel value 501.

Figure 6:
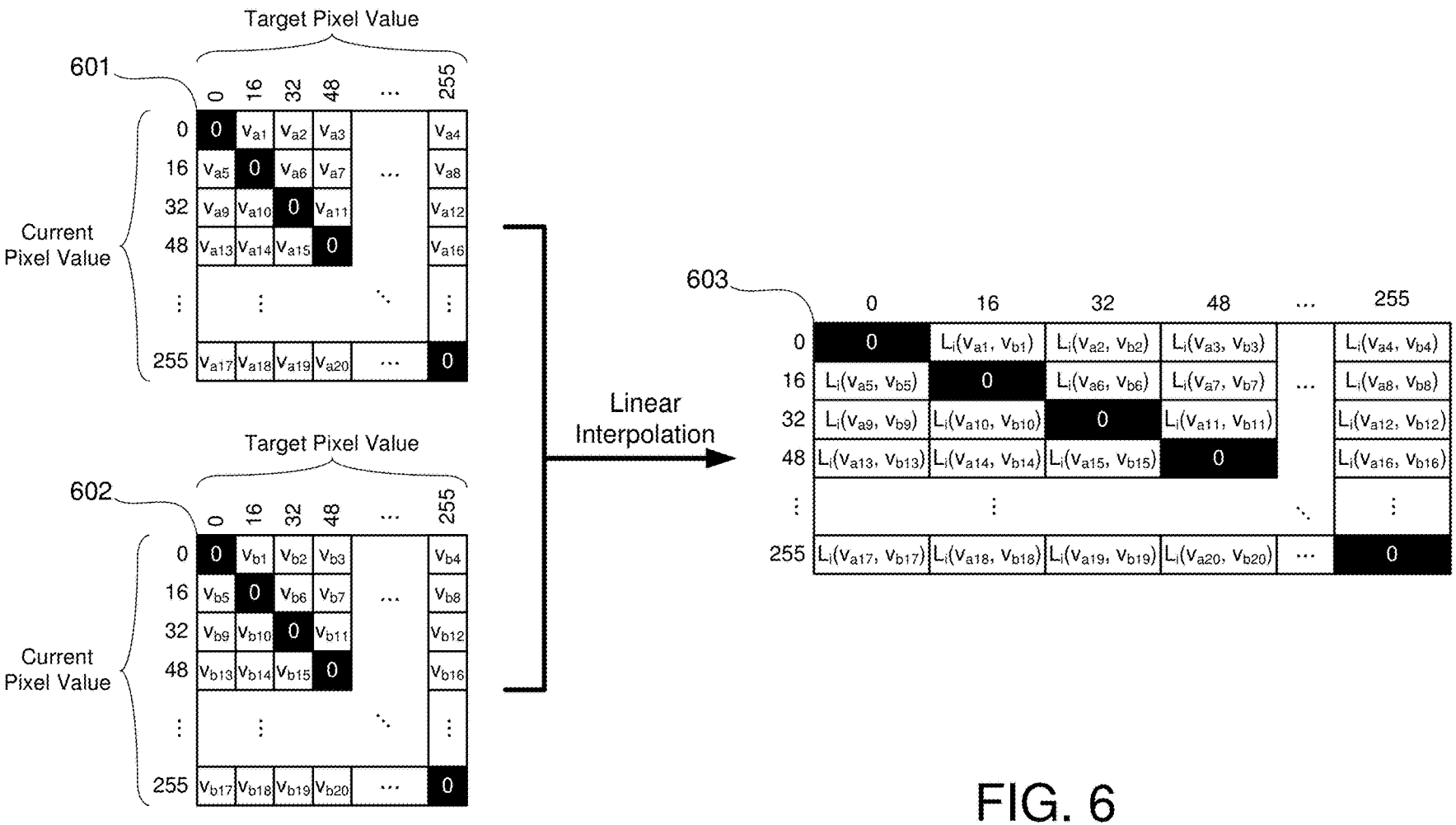
FIG. 6 shows an example pair of look-up tables (LUTs) that can be used to generate progressive overdrive voltages, in accordance with some embodiments.

FIG. 6 shows an example pair of look-up tables (LUTs) 601 and 602 that can be used to generate progressive overdrive voltages, in accordance with some embodiments. In the example of FIG. 6, each of the LUTs 601 and 602 may be a 17×17 LUT. Each element (e.g., cell) of the LUTs may store an 8-bit grayscale pixel value. Each of the LUTs 601 and 602 may be associated with a different row of pixel elements in a corresponding pixel array.

In a particular example, with reference to FIG. 4B, the first LUT 601 may be associated with the row of pixel elements at line number $l_n$ and the second LUT 602 may be associated with the row of pixel elements at line number $l_p$. Thus, the first LUT 601 may include a plurality of overdrive voltages (e.g., $v_{a1}$-$v_{a20}$) that can be used to drive a pixel element coupled to line number $l_n$ from a current pixel value (e.g., indexed along the rows of the LUT 601) to a target pixel value (e.g., indexed along the columns of the LUT 601). Similarly, the second LUT 602 may include a plurality of overdrive voltages (e.g., $v_{b1}$-$v_{b20}$) that can be used to drive a pixel element coupled to line number $l_p$ from a current pixel value (e.g., indexed along the rows of the LUT 602) to a target pixel value (e.g., indexed along the columns of the LUT 602). Because the pixel elements coupled to line number $l_n$ may have more time to reach their target pixel values than the pixel elements coupled to line number $l_p$, each of the overdrive voltages in the second LUT 602 may be greater than corresponding overdrive voltages in the first LUT 601 (e.g., $V_{b1}>V_{a1}$, $V_{b2}>V_{a2}$, $V_{b3}>V_{a3}$, etc.)

In some embodiments, the LUTs 601 and 602 may be used to derive overdrive voltages for pixel elements in any row of the array between line numbers $l_n$ and $l_p$ (e.g., based on a bilinear interpolation of the LUTs 601 and 602). In some aspects, the LUTs 601 and 602 may be combined, through linear interpolation, to produce a new LUT 603 for a selected row of pixel elements between lines numbers $l_n$ and $l_p$. Thus, each element of the new LUT 603 may be generated based on a linear interpolation of corresponding elements in the first and second LUTs 601 and 602, as represented by the equation below:

$$\text{overdrive_voltage}=L_i(v_{ax},v_{bx})$$

where i is the overdrive index for the selected row of pixel elements, and x may be any integer value from 1 to 272. Thus, depending on the overdrive index, the linear interpolation of the overdrive voltages from LUT 601 and LUT 602 may result in a plurality of voltages that are closer to those of the first LUT 601 (e.g., if the selected row of pixel elements is closer to line $l_n$) or closer to those of the second LUT 602 (e.g., if the selected row of pixel elements is closer to line $l_p$).

Each cell of the new LUT 603 may represent a respective overdrive voltage that can be used to drive a pixel element in the selected row from a current pixel value (e.g., indexed along the rows of the LUT 603) to a target pixel value (e.g., indexed along the columns of the LUT 603). It is noted that the new LUT 603 (as well is the other LUTs 601 and 602) may include only a subset of the total possible grayscale values (e.g., 0, 16, 32, 48, 64, 80, 96, 112, 128, 144, 160, 176, 192, 208, 224, 240, and 255). Thus, an additional step of interpolation may be used to determine the overdrive voltages associated with any grayscale values that fall between the grayscale values explicitly identified in the LUT 603. For example, the overdrive voltage to be used to drive a pixel element from a grayscale value of 8 to a grayscale value of 20 may be determined based on a bilinear interpolation of the current grayscale values 0 and 16 and the target grayscale values 16 and 32.

Figure 7:
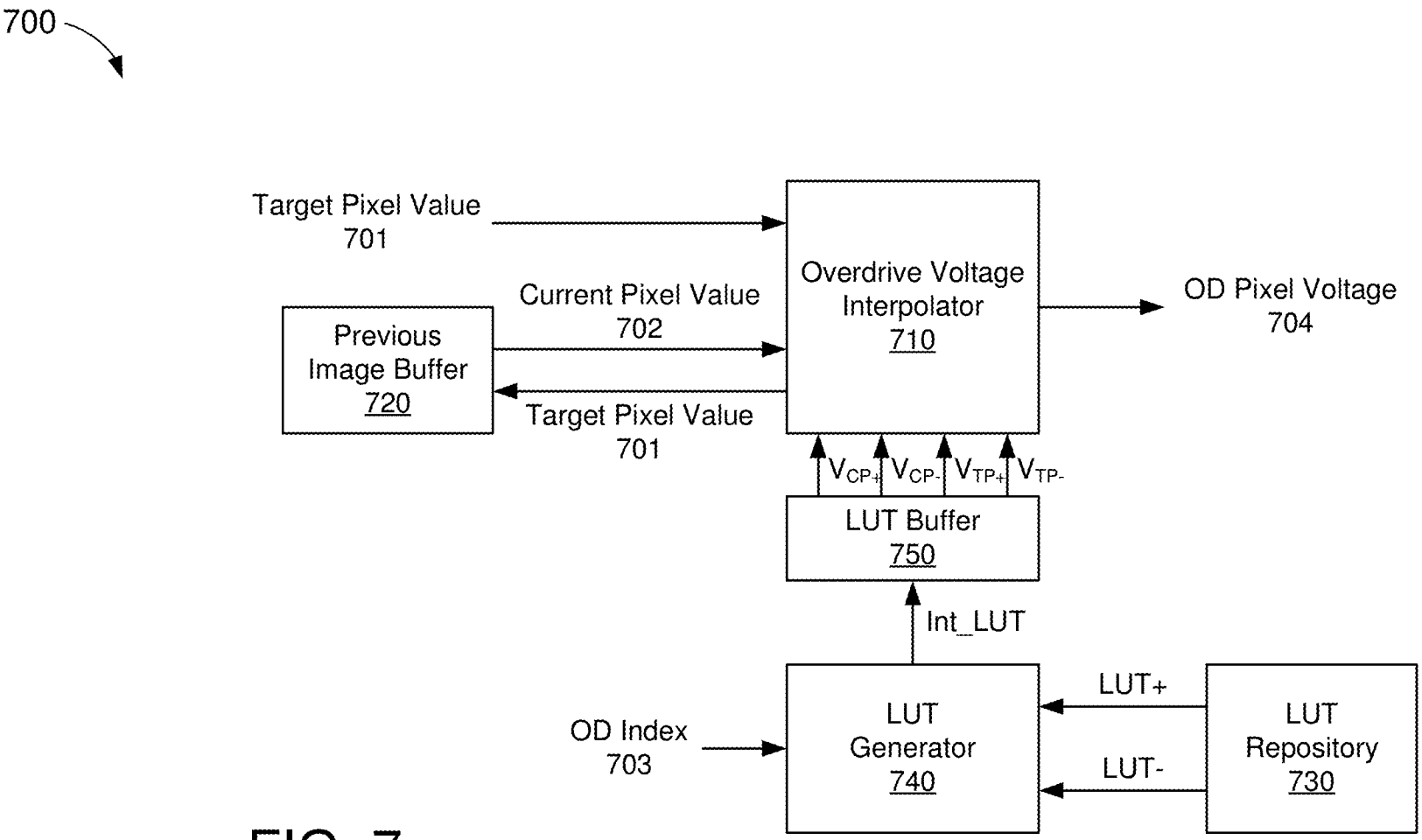
FIG. 7 shows a block diagram of a progressive overdrive controller, in accordance with some other embodiments.

FIG. 7 shows a block diagram of a progressive overdrive controller 700, in accordance with some other embodiments. The progressive overdrive controller 700 may be an example embodiment of the progressive overdrive controller 500A of FIG. 5A and/or the overdrive circuitry 240 of FIG. 2. Thus, the progressive overdrive controller 700 may be configured to progressively increase the amount of overdrive applied to one or more rows of pixel elements of a pixel array (such as the pixel array 210 of FIG. 2) based, at least in part, on the row position in the array 210.

The progressive overdrive controller 700 includes an overdrive voltage interpolator 710, a previous image buffer 720, a lookup table (LUT) repository 730, a lookup table (LUT) generator 740, and a lookup table (LUT) buffer 750. The overdrive voltage interpolator 710 may determine an overdrive pixel voltage 704 to be applied to each pixel element of the associated pixel array. More specifically, the overdrive voltage interpolator 710 may generate the overdrive pixel voltage 704 based, at least in part, on a target pixel value 701, a current pixel value 702, and a lookup table (LUT). The target pixel value 701 may correspond to the pixel value that a particular pixel element is to be driven by the next display period. For example, the target pixel value 701 may be provided by an input image buffer (such as the display memory 230 of FIG. 2). The current pixel value 702 may correspond to the pixel value, for the particular pixel element, that was displayed during the previous display period. For example, the current pixel value 702 may be stored in, and retrieved from, the previous image buffer 720. In some aspects, after each frame update, the overdrive voltage interpolator 710 may store the target pixel value 701 of the current frame in the previous image buffer 720 (e.g., to be used as the current pixel value 702 for the next frame update).

In some embodiments, the overdrive voltage interpolator 710 may determine the overdrive pixel voltage 704 by comparing the target pixel value 701 with the current pixel value 702. More specifically, the overdrive voltage interpolator 710 may determine an amount of voltage to be applied to a corresponding pixel element to change the pixel value from the current pixel value 702 to the target pixel value 701. In some aspects, the overdrive voltage interpolator 710 may compare the target pixel value 701 and the current pixel value 702 to corresponding values in a LUT to determine the overdrive pixel voltage 704. In some embodiments, the progressive overdrive controller 700 may progressively increase (or decrease) the amount of overdrive voltage, for a given change in pixel value, for a plurality of successive rows of pixel elements in the pixel array. Thus, in some aspects, the overdrive voltage interpolator 710 may use different (or updated) LUTs to determine the overdrive pixel voltages 704 for different rows of the pixel array.

In some embodiments, the LUT repository 730 may store a plurality of LUTs associated with different rows of the pixel array. More specifically, the LUT repository 730 may store LUTs for only a subset of rows of the pixel array. In some aspects, the LUT repository 730 may store at least 2, and up to 5, LUTs for a given pixel array. At least one of the LUTs may be associated with a minimum overdrive voltage to be applied to one or more rows of pixel elements in the array (e.g., pixel elements coupled to line number $l_0$ of FIG. 4A or line numbers $l_0$-$l_n$ of FIG. 4B), and at least one of the LUTs may be associated with a maximum overdrive voltage to be applied to one or more rows of pixel elements in the array (e.g., pixel elements coupled to line numbers $l_p$-$l_M$ in FIGS. 4A and 4B).

The LUT generator 740 may retrieve one or more LUTs (LUT+ and LUT−) from the LUT repository 730 based, at least in part, on an overdrive index 703. In some aspects, the overdrive index 703 may be based, at least in part, on the line or row number associated with the pixel elements to be drive. In some other aspects, the overdrive index 703 may be based on a combination of factors including, but not limited to, the line or row number associated with the pixel elements to be driven and the temperature of the display. In some embodiments, the LUT generator 740 may retrieve a pair of LUTs that are closest to the overdrive index 703. For example, if the overdrive index 703 corresponds to a particular LUT stored in the LUT repository 730, the LUT generator 740 may retrieve two copies of the same LUT. However, if the overdrive index 703 does not correspond to any particular LUT stored in the LUT repository, the LUT generator 740 may retrieve the closest LUT having an index above the overdrive index 703 (e.g., LUT+) associated with the overdrive index 703 and the closest LUT having an index below the overdrive index 703 (e.g., LUT−).

The LUT generator 740 may interpolate the LUTs retrieved from the LUT repository 730 to generate an interpolated LUT (Int_LUT). In some embodiments, the interpolated LUT may be based, at least in part, on a linear interpolation of the LUTs retrieved from the LUT repository 730 (e.g., as described above with respect to FIG. 6). More specifically, each element of the interpolated LUT may be generated based on a linear interpolation of corresponding elements in LUT+ and LUT−. Thus, depending on the overdrive index 703, the overdrive voltages in the interpolated LUT may be closer to the voltages of LUT+ (e.g., if the overdrive index 703 is closer to that of LUT+) or closer to the voltages of LUT− (e.g., if the overdrive index 703 is closer to that of LUT−). Each cell of the interpolated LUT may represent a respective overdrive voltage that can be used to drive a pixel element in a selected row of the pixel array (e.g., associated with the overdrive index 703) from a current pixel value to a target pixel value.

The interpolated LUT may be stored in the LUT buffer 750 and accessed by the overdrive voltage interpolator 710. For example, the overdrive voltage interpolator 710 may look up the target pixel value 701 and the current pixel value 702 in the interpolated LUT to determine the overdrive pixel voltage 704. In some embodiments, the interpolated LUT may include only a subset of the total possible grayscale values for each of the target pixel values and current pixel values. Thus, in some aspects, the overdrive voltage interpolator 710 may interpolate the pixel values in the interpolated LUT to generate the overdrive pixel voltage 704. For example, the overdrive voltage interpolator 710 may retrieve the row of overdrive voltages associated with the closest current pixel value (in Int_LUT) above the current pixel value 702 (e.g., $V_{CP+}$), the row of overdrive voltages associated with the closest current pixel value (in Int_LUT) below the current pixel value 702 (e.g., $V_{CP-}$), the column of overdrive voltages associated with the closest target pixel value (in Int_LUT) above the target pixel value 701 (e.g., $V_{TP+}$), and the column of overdrive voltages associated with the closest target pixel value (in Int_LUT) below the target pixel value 701 (e.g., $V_{TP-}$). The overdrive voltage interpolator 710 may then generate the overdrive pixel voltage 704 based on a bilinear interpolation of $V_{CP+}$, $V_{CP-}$, $V_{TP+}$, and $V_{TP-}$.

It is noted that, when implementing progressive overdrive, the overdrive voltage interpolator 710 may use a different (or updated) interpolated LUT for each successive row of pixel elements in the array. Thus, in some embodiments, interpolated LUTs from the LUT generator 740 may be double-buffered by the LUT buffer 750. For example, the LUT buffer 750 may store the interpolated LUT for the current row of pixel elements as well as the interpolated LUT for the next row of pixel elements to be processed by the overdrive voltage interpolator 710. This allows the overdrive voltage interpolator 710 to derive the overdrive pixel voltages 704 for the next row of pixel elements immediately after processing the overdrive pixel voltages 704 for the current row of pixel elements (e.g., without waiting for the next interpolated LUT to be buffered).

In conventional display systems, LCD overdrive circuitry (such as the overdrive circuitry 240 of FIG. 2) is provided on (or implemented by) a display driver residing on the display device (e.g., display device 120). Thus, the display driver may generate the overdrive voltages to be applied to each pixel element while concurrently rendering each frame of display data received from the host. However, because several LUTs are used to implement progressive overdrive, the display device may require a substantial amount of memory and other hardware resources to store and process each LUT for the various rows of pixel elements. Since resources are much more limited on a display device than a host device, it may be desirable to perform some (or all) of the progressive overdrive processing on the host device.

In some embodiments, the overdrive voltages for each pixel element in the pixel array may be generated or determined by the host device. With reference for example to FIG. 1, the host device 110 may generate the overdrive voltages concurrently while processing the image source data 101 for display on the display device 120. Accordingly, the host device 110 may send the overdrive voltage information, together with the display data 102, to the display device 120. In some embodiments, the host device 110 may record the overdrive voltage information in the display data 102. Thus, upon receiving the display data 102 from the host device 110, the display device 120 may render the corresponding image on the display 122 using the correct overdrive voltages for each row of pixel elements in that particular frame.

Figure 8:
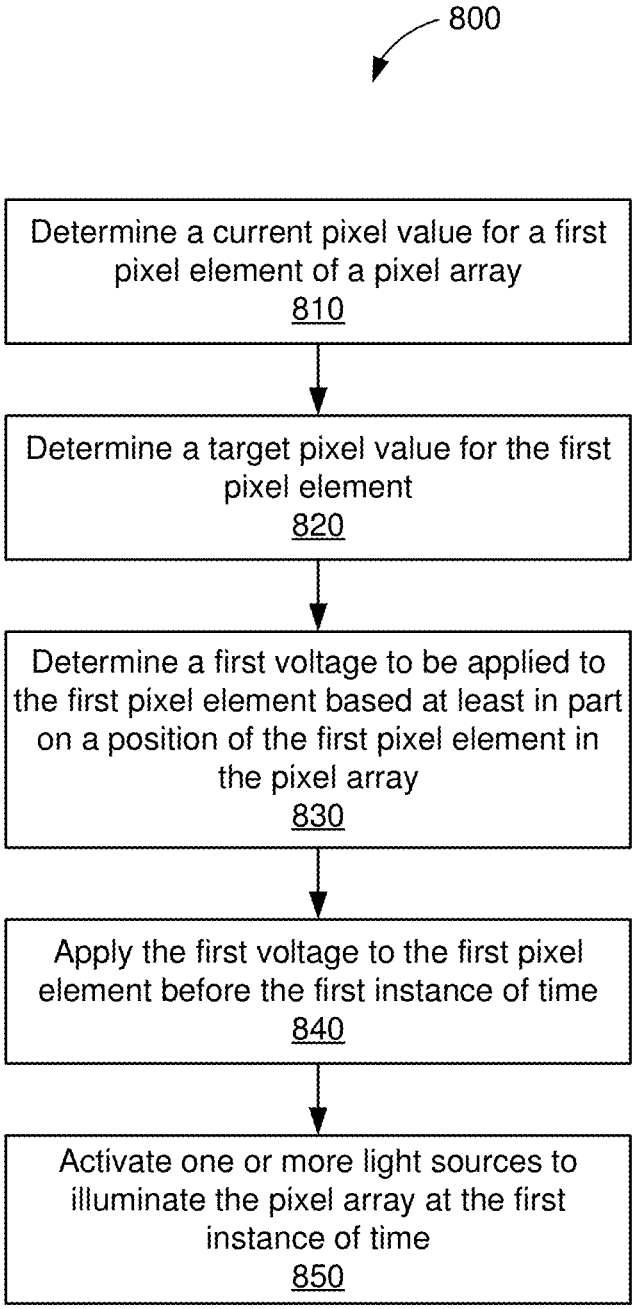
FIG. 8 is an illustrative flowchart depicting an example operation for driving a pixel element of a display to a target pixel value.

FIG. 8 is an illustrative flowchart depicting an example operation 800 for driving a pixel element of a display to a target pixel value. With reference for example to FIGS. 1 and 2, the example operation 800 may be performed by any display device of the present disclosure (e.g., display device 120 or display device 200).

The display device determines a current pixel value for a first pixel element of a pixel array (810). For example, the current pixel value may correspond to a color and/or intensity of the first pixel element as currently on display (e.g., for the current frame or image). The first pixel element may comprise a plurality of subpixels including, but not limited to, red (R), green (G), and blue (B) subpixels. In some aspects, the current pixel value may correspond to R, G, and B values for the subpixels of the first pixel element. The R, G, and B values may affect the color and intensity (e.g., gray level) of the first pixel element. For example, each pixel value may be an 8-bit value representing one of 256 possible grayscale levels.

The display device further determines a target pixel value for the first pixel element (820). For example, the target pixel value may correspond to a desired color and/or intensity of the first pixel element to be displayed (e.g., for the next frame or image in a sequence). The target pixel value may be achieved by applying voltage to the first pixel element. More specifically, the voltage may change the physical state (e.g., rotation) of the first pixel element, resulting in a corresponding change in color and/or intensity. In some aspects, the target pixel value may be associated with a target voltage which, when applied to the first pixel element, causes the first pixel element to settle at the target pixel value.

The display device may determine a first voltage to be applied to the first pixel element based at least in part on a position of the first pixel element in the pixel array (830). More specifically, the first voltage may cause the first pixel element to transition from the current pixel value to the target pixel value by a first instance of time (e.g., the start of a display period). However, aspects of the present disclosure recognize that, because a pixel array is updated on a row-by-row basis, different pixel elements may have different transition times depending on their row positions in the pixel array. For example, pixel elements associated with higher line numbers (e.g., pixel elements that are updated later) may have less time to transition to their desired pixel values than pixel elements associated with lower line numbers (e.g., pixel elements that are updated earlier). Accordingly, the row position of the first pixel element may affect the amount of time the first pixel element has to transition from the current pixel value to the target pixel value as well as the voltage to be applied to cause the transition within the allotted time.

The display device may apply the first voltage to the first pixel element before the first instance of time (840) and activate one or more light sources to illuminate the pixel array at the first instance of time (850). For example, the first pixel element may begin to transition towards the target pixel value once the first voltage is applied. However, the first pixel element may or may not settle at the target pixel value by the start of the display period depending on its row position. For example, when driven to the target voltage, the first pixel element may settle at the target pixel value by the start of the display period. When driven to an overdrive voltage, the first pixel element may reach the target pixel value at the start of the display period but may continue to transition even after the display period (e.g., eventually settling at a higher or lower pixel value than the target pixel value). However, because the pixel elements are illuminated only during the display periods, any changes in pixel value exhibited before or after the display period will not be seen by the user.

Figure 9:
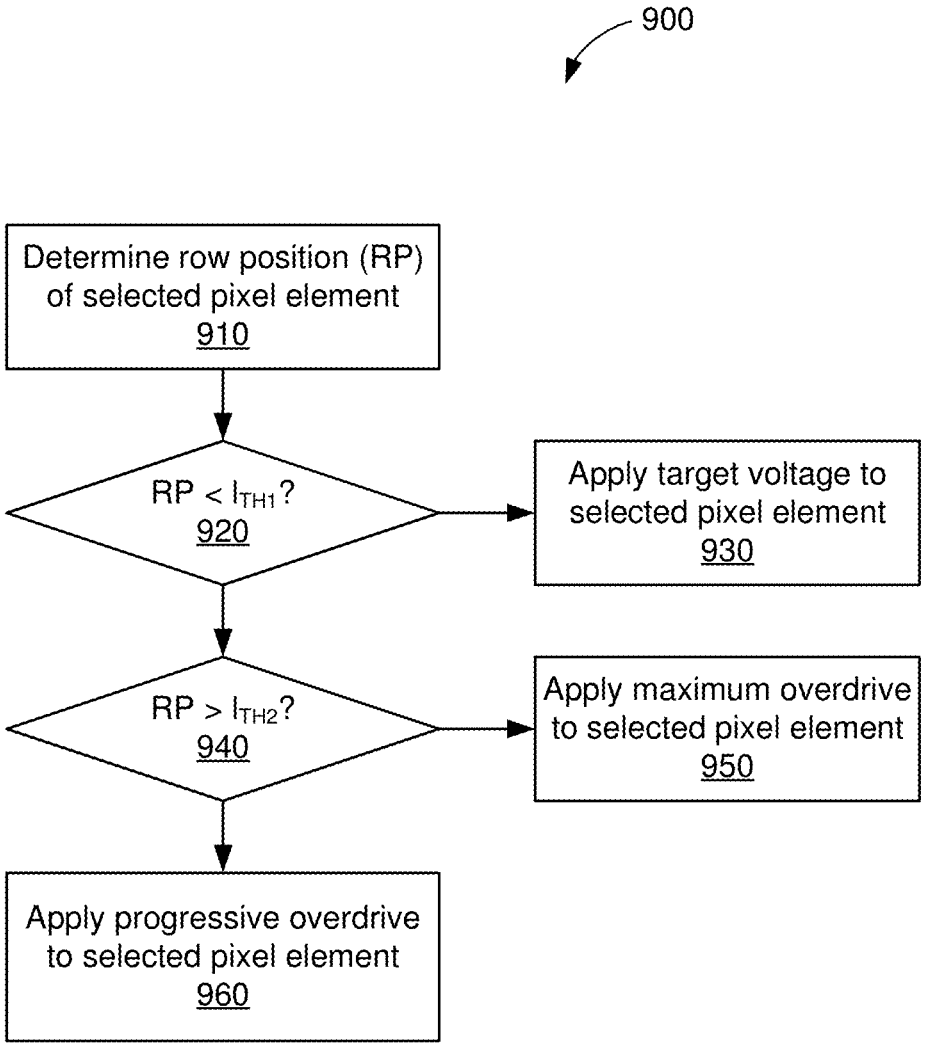
FIG. 9 is an illustrative flowchart depicting an example operation for selectively applying overdrive voltages to the pixel elements of a pixel array.

FIG. 9 is an illustrative flowchart depicting an example operation 900 for selectively applying overdrive voltages to the pixel elements of a pixel array. With reference for example to FIGS. 2, 5A, 5B, and 7 the example operation 900 may be performed by the overdrive circuitry 240 and/or the progressive overdrive controller 500A, 500B, and/or 700. In some embodiments, the example operation 900 may be used to determine the voltage to be applied to a particular pixel element to cause the pixel element to transition from a current pixel value to a target pixel value.

The overdrive circuitry may first determine a row position of a selected pixel element (910). For example, the row position may correspond to a particular line number of the corresponding pixel array. In some aspects, the row position may indicate an order in which the selected pixel element is updated in the pixel array. For example, individual rows of the pixel array may be successively updated (e.g., one row at a time), from the lowest line number ($l_0$) to the highest line number ($l_M$).

The overdrive circuitry may compare the row position of the selected pixel element to a first threshold line number limn (920). For example, the first threshold line number (e.g., line $l_n$ of FIG. 4B) may correspond to a row of the pixel array at which overdrive is first applied. Aspects of the present disclosure recognize that, because a pixel array is updated on a row-by-row basis, different pixel elements may have different transition times depending on their row positions in the pixel array. More specifically, pixel elements having a row position lower than the first threshold line number (e.g., between lines $l_0$ and $l_n$) may have sufficient time to settle at their target pixel values before the next display period.

Thus, when the row position of the selected pixel element is lower than the first threshold line number (as tested at 920), the overdrive circuitry may select the target voltage to be applied to the selected pixel element (930). As described above, the target voltage may be a voltage which, when applied to the selected pixel element, causes the selected pixel element to settle at the target pixel value.

However, when the row position of the selected pixel element is not lower than the first threshold line number (as tested at 920), the overdrive circuitry may further compare the row position of the selected pixel element to a second threshold line number $l_{TH2}$ (940). For example, the second threshold line number (e.g., line $l_p$ of FIGS. 4A and 4B) may correspond to a row of the pixel array at which maximum overdrive is first applied. Aspects of the present disclosure recognize that the amount of voltage that can be applied to a pixel element may be limited by the voltage range of the pixel element (or data driver). Accordingly, the overdrive voltage may become saturated by the time pixel elements having a row position higher than the second threshold line number (e.g., above line $l_p$) are updated.

Thus, when the row position of the selected pixel element is higher than the second threshold line number (as tested at 940), the overdrive circuitry generator may select a maximum overdrive voltage to be applied to the selected pixel element (950). As described above, the maximum overdrive voltage may be the highest (or lowest) achievable voltage in the voltage range of the pixel element (or data driver).

However, when the row position of the selected pixel element falls between the first threshold line number (as tested at 930) and the second threshold line number (as tested at 940), the overdrive circuitry may apply a progressive overdrive to the selected pixel element (960). As described above with respect to FIGS. 4A and 4B, the amount of overdrive may be progressively increased for each successive row of pixel elements from lines $l_n$ to $l_p$. For example, a pixel element coupled to line $l_p$ may be driven to a higher voltage than a pixel element coupled to line $l_n$ to produce the same change in pixel value. In some embodiments, the overdrive circuitry may determine the amount of overdrive voltage to be applied to the selected pixel element based at least in part on one or more lookup tables (LUTs) stored in an LUT repository.

Figure 10:
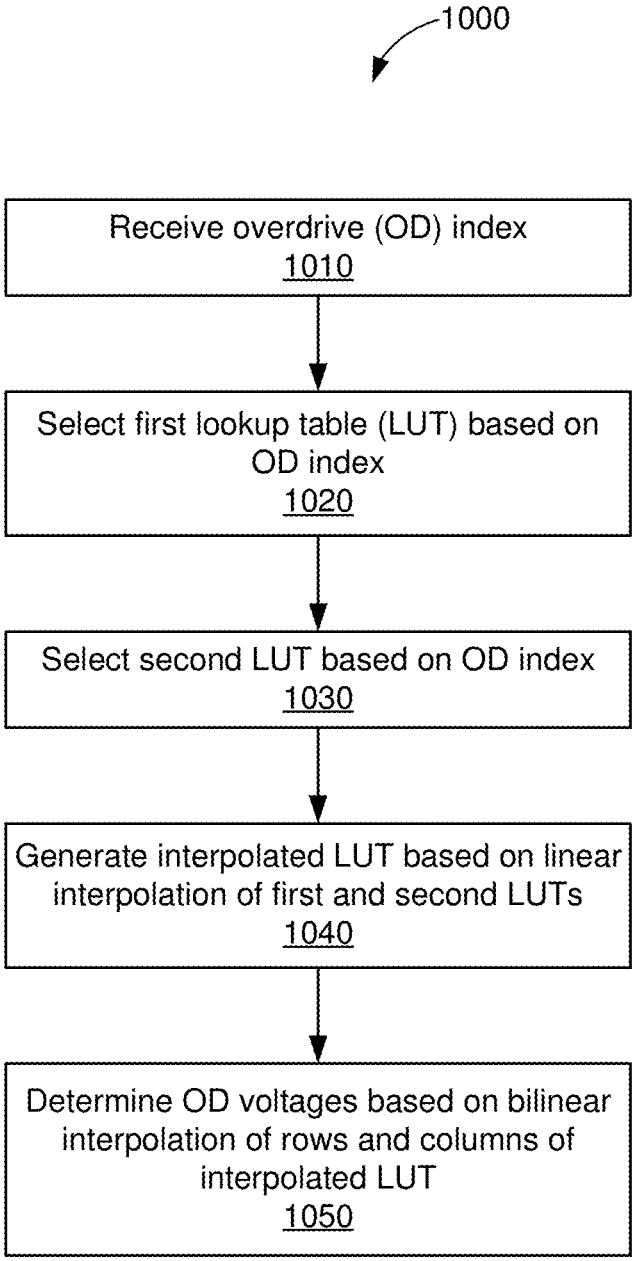
FIG. 10 is an illustrative flowchart depicting an example operation for determining an overdrive voltage to be used to drive a pixel element to a target pixel value.

FIG. 10 is an illustrative flowchart depicting an example operation 1000 for determining an overdrive voltage to be used to drive a pixel element to a target pixel value. With reference for example to FIGS. 2, 5A, 5B, and 7 the example operation 1000 may be performed by the overdrive circuitry 240 and/or the progressive overdrive controller 500A, 500B, and/or 700. In some embodiments, the example operation 1000 may be used to determine the voltage to be applied to a particular pixel element to cause the pixel element to transition from a current pixel value to a target pixel value.

The overdrive circuitry may first receive an overdrive index (1010). In some aspects, the overdrive index 503 may be based, at least in part, on the line or row number associated with the pixel element(s) to be driven. However, other factors may also affect the amount of overdrive voltage needed to achieve a desired change in pixel value within a frame update period. For example, the responsiveness of the liquid crystals may vary with respect to the temperature of the display. Thus, in some embodiments, the overdrive index 503 may be based on a combination of factors including, but not limited to, the line or row number associated with the pixel elements to be driven and the temperature of the display.

The overdrive circuitry may select a first lookup table (LUT) based on the overdrive index (1020). For example, the overdrive circuitry may include a LUT repository that stores a plurality of LUTs. More specifically, each of the LUTs may indicate a plurality of overdrive voltages for pixel elements in a corresponding row of the pixel array (as described above with respect to FIG. 6). In some embodiments, the LUT repository may store a different LUT for each row of the pixel array. In some other embodiments, the LUT repository may store LUTs for some, but not all, of the rows of the pixel array. The first LUT selected by the overdrive circuitry may correspond to an LUT associated with the nearest row equal to or below the row position or line number indicated by the overdrive index.

The overdrive circuitry may further select a second LUT based on the overdrive index (1030). The second LUT selected by the overdrive circuitry may correspond to an LUT associated with the nearest row equal to or above the row position or line number indicated by the overdrive index. As described above, in some embodiments, the LUT repository may store a different LUT for each row of the pixel array. In such implementations, there may be an exact LUT associated with the row position indicated by the overdrive index. Thus, in some aspects, the second LUT may be the same as the first LUT (e.g., the nearest LUT equal to or above the overdrive index is the same as the nearest LUT equal to or below the overdrive index).

The overdrive circuitry may generate an interpolated LUT based on a linear interpolation of the first and second LUTs (1040). For example, each element of the interpolated LUT may be generated based on a linear interpolation of corresponding elements in the first LUT and the second LUT (e.g., as described above with respect to FIG. 6). Thus, depending on the overdrive index, the overdrive voltages in the interpolated LUT may be closer to the voltages of the first LUT (e.g., if the overdrive index is closer to the row associated with the first LUT) or closer to the voltages of the second LUT (e.g., if the overdrive index is closer to the row associated with the second LUT).

Finally, the overdrive circuitry may determine overdrive voltages to be applied to the row of pixel elements associated with the overdrive index based on a bilinear interpolation of the rows and columns of the interpolated LUT (1050). For example, each cell of the interpolated LUT may represent a respective overdrive voltage that can be used to drive a pixel element in a selected row of the pixel array from a current pixel value to a target pixel value (e.g., as described above with respect to FIG. 6). However, in some embodiments, the interpolated LUT may include only a subset of the total possible grayscale values for each of the target pixel values and current pixel values. Thus, in some aspects, the overdrive circuitry may interpolate the pixel values in the interpolated LUT to determine the overdrive voltage to effect a transition from any current pixel value to any target pixel value (e.g., as described above with respect to FIG. 6).

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The methods, sequences or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

In the foregoing specification, embodiments have been described with reference to specific examples thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. A method of updating pixel values of a pixel array, comprising:

determining a current pixel value and a target pixel value for a first pixel element disposed in a first row of a plurality of rows of the pixel array;

determining a target voltage which causes the first pixel element to settle at the target pixel value;

determining a first amount of overdrive voltage to be applied to the first pixel element based at least in part on a display period associated with the pixel array and an order in which voltages are applied to the plurality of rows during a pixel adjustment period preceding the display period, the overdrive voltage being greater than the target voltage;

applying the first amount of overdrive voltage to the first pixel element during the pixel adjustment period; and activating one or more light sources to illuminate the pixel array during the display period.

2. The method of claim 1, wherein the first amount of overdrive voltage is determined to cause the first pixel element to transition from the current pixel value to the target pixel value by the start of the display period.

3. The method of claim 1, further comprising:

determining a current pixel value and a target pixel value for a second pixel element disposed in a second row of the plurality of rows, wherein a change in pixel value from the current pixel value to the target pixel value of the second pixel element is equal to a change in pixel value from the current pixel value to the target pixel value of the first pixel element; and determining a second amount of overdrive voltage to be applied to the second pixel element based at least in part on the display period and the order in which voltages are applied to the plurality of rows of the pixel array during the pixel adjustment period, the second amount of overdrive voltage being different than the first amount.

4. The method of claim 3, wherein voltages are applied to the first row of the pixel array earlier in the pixel adjustment period than to the second row and the first amount of overdrive voltage is less than the second amount.

5. The method of claim 3, wherein voltages are applied to the first row of the pixel array later in the pixel adjustment period than to the second row and the first amount of overdrive voltage is greater than the second amount.

6. The method of claim 1, wherein the first amount of overdrive voltage is determined based at least in part on a plurality of lookup tables (LUTs), each of the plurality of LUTs indicating a plurality of overdrive voltages for pixel elements in a respective row of the plurality of rows.

7. The method of claim 6, wherein the determining of the first amount of overdrive voltage further comprises:

selecting a first LUT of the plurality of LUTs associated with one of the plurality of rows below the first row;

selecting a second LUT of the plurality of LUTs associated with one of the plurality of rows above of the first row; and performing a linear interpolation of the first LUT and the second LUT to determine the first amount of overdrive voltage.

8. The method of claim 7, wherein the determining of the first amount of overdrive voltage further comprises:

generating an interpolated LUT based on the linear interpolation of the first and second LUTs;

selecting at least two rows of the interpolated LUT based on the current pixel value;

selecting at least two columns of the interpolated LUT based on the target pixel value; and performing a bilinear interpolation of the selected rows and columns of the interpolated LUT to determine the first amount of overdrive voltage.

9. The method of claim 7, wherein the first and second LUTs are selected based at least in part on a temperature of the pixel array.

10. The method of claim 1, wherein the determining of the first amount of overdrive voltage comprises:

determining a maximum amount of overdrive voltage applicable to the first pixel element based on a voltage range of a data driver configured to supply the overdrive voltage;

determining whether a line number associated with the first row is greater than or equal to a threshold line number of the pixel array; and selecting the first amount of overdrive voltage to be equal to the maximum amount responsive to determining that the line number is greater than or equal to the threshold line number.

11. A display device, comprising:

one or more processors; and a memory storing instructions that, when executed by the one or more processors, cause the display device to:

determine a current pixel value and a target pixel value for a first pixel element disposed in a first row of a plurality of rows of a pixel array;

determine a target voltage which causes the first pixel element to settle at the target pixel value; and determine a first amount of overdrive voltage to be applied to the first pixel element based at least in part on a display period associated with the pixel array and an order in which voltages are applied to the plurality of rows during a pixel adjustment period preceding the display period, the overdrive voltage being greater than the target voltage;

apply the first amount of overdrive voltage to the first pixel element during the pixel adjustment period; and activate one or more light sources to illuminate the pixel array during the display period.

12. The display device of claim 11, wherein the first amount of overdrive voltage is determined to cause the first pixel element to transition from the current pixel value to the target pixel value by the start of the display period.

13. The display device of claim 11, wherein execution of the instructions further causes the display device to:

determine a current pixel value and a target pixel value for a second pixel element disposed in a second row of the plurality of rows, wherein a change in pixel value from the current pixel value to the target pixel value of the second pixel element is equal to a change in pixel value from the current pixel value to the target pixel value of the first pixel element; and determine a second amount of overdrive voltage to be applied to the second pixel element based at least in part on the display period and the order in which voltages are applied to the plurality of rows of the pixel array during the pixel adjustment period, the second amount of overdrive voltage being different than the first amount.

14. The display device of claim 13, wherein voltages are applied to the first row of the pixel array earlier in the pixel adjustment period than to the second row and the first amount of overdrive voltage is less than the second amount.

15. The display device of claim 13, wherein voltages are applied to the first row of the pixel array later in the pixel adjustment period than to the second row and the first amount of overdrive voltage is greater than the second amount.

16. The display device of claim 11, wherein the first amount of overdrive voltage is determined based at least in part on a plurality of lookup tables (LUTs), each of the plurality of LUTs indicating a plurality of overdrive voltages for pixel elements in a respective row of the plurality of rows.

17. The display device of claim 16, wherein execution of the instructions for determining the first amount of overdrive voltage further causes the display device to:

select a first LUT, of the plurality of LUTs, associated with one of the plurality of rows below the first row;

select a second LUT, of the plurality LUTs, associated with one of the plurality of rows above the first row; and perform a linear interpolation of the first LUT and the second LUT to determine the first amount of overdrive voltage.

18. The display device of claim 17, wherein execution of the instructions for determining the first amount of overdrive voltage further causes the display device to:

generate an interpolated LUT based on the linear interpolation of the first and second LUTs;

select at least two rows of the interpolated LUT based on the current pixel value;

select at least two columns of the interpolated LUT based on the target pixel value; and perform a bilinear interpolation of the selected rows and columns of the interpolated LUT to determine the first amount of overdrive voltage.

19. The display device of claim 17, wherein the first and second LUTs are selected based at least in part on a temperature of the pixel array.

20. The display device of claim 11, wherein execution of the instructions for determining the first amount of overdrive voltage causes the display device to:

determine a maximum amount of overdrive voltage applicable to the first pixel element based on a voltage range of a data driver configured to supply the overdrive voltage;

determine whether a line number associated with the first row is greater than or equal to a threshold line number of the pixel array; and select the first amount of overdrive voltage to be equal to the maximum amount responsive to determining that the line number is greater than or equal to the threshold line number.

* * * * *